US007947086B2

(12) United States Patent
Panandiker et al.

(10) Patent No.: US 7,947,086 B2
(45) Date of Patent: May 24, 2011

(54) METHOD FOR CLEANING HOUSEHOLD FABRIC-BASED SURFACE WITH PREMOISTENED WIPE

(75) Inventors: Rajan Keshav Panandiker, West Chester, OH (US); Glenn Thomas Jordan, IV, Indian Springs, OH (US); Alice Jean Michels, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 672 days.

(21) Appl. No.: 11/443,836

(22) Filed: May 31, 2006

(65) Prior Publication Data

US 2006/0276356 A1 Dec. 7, 2006

Related U.S. Application Data

(63) Continuation-in-part of application No. 11/216,836, filed on Aug. 31, 2005.

(60) Provisional application No. 60/685,815, filed on May 31, 2005, provisional application No. 60/606,820, filed on Sep. 1, 2004, provisional application No. 60/731,718, filed on Oct. 31, 2005.

(51) Int. Cl.

| | |
|---|---|
| ***C11D 3/37*** | (2006.01) |
| ***D06L 1/02*** | (2006.01) |
| ***B08B 3/04*** | (2006.01) |

(52) U.S. Cl. ..... 8/137; 134/42

(58) Field of Classification Search ..... 8/137; 134/42
See application file for complete search history.

(56) References Cited

U.S. PATENT DOCUMENTS

| | | | | |
|---|---|---|---|---|
| 1,186,960 | A | | 6/1916 | Wells |
| 2,093,824 | A | | 9/1937 | Woronoff |
| 2,947,016 | A | | 8/1960 | Thompson |
| 2,969,626 | A | | 1/1961 | Rudes |
| 2,999,265 | A | | 9/1961 | Duane et al. |
| 3,099,855 | A | | 8/1963 | Nash |
| 3,124,825 | A | | 3/1964 | Iovenko |
| 3,129,811 | A | | 4/1964 | Williams |
| 3,196,478 | A | | 7/1965 | Baymiller et al. |
| 3,334,374 | A | | 8/1967 | Watkins, Jr. |
| 3,448,478 | A | | 6/1969 | Nash et al. |
| 3,472,675 | A | | 10/1969 | Gordon et al. |
| 3,499,575 | A | | 3/1970 | Rockefeller |
| 3,533,533 | A | | 10/1970 | Chaney, Jr. |
| 3,534,887 | A | | 10/1970 | Ginsberg |
| 3,561,456 | A | | 2/1971 | Stuart, Jr. |
| 3,567,118 | A | | 3/1971 | Shepherd |
| 3,624,224 | A | | 11/1971 | Wei |
| 3,704,480 | A | | 12/1972 | Whitaker |
| 3,748,268 | A | | 7/1973 | Loudas |
| 3,764,544 | A | | 10/1973 | Haworth |
| 3,818,533 | A | | 6/1974 | Scheuer |
| 3,827,857 | A | | 8/1974 | Boulus |
| 3,965,518 | A | | 6/1976 | Muoio |
| 3,965,519 | A | | 6/1976 | Hermann |
| 4,124,542 | A | | 11/1978 | Devine |
| 4,145,302 | A | | 3/1979 | Doan |
| 4,189,395 | A | | 2/1980 | Bland |
| 4,328,279 | A | | 5/1982 | Meitner et al. |
| 4,336,024 | A | | 6/1982 | Denissenko et al. |
| 4,372,867 | A | | 2/1983 | Taragos |
| 4,409,116 | A | | 10/1983 | Lodico |
| 4,423,091 | A | * | 12/1983 | Iwasaki et al. ..... 427/213.34 |
| 4,426,417 | A | | 1/1984 | Meitner et al. |
| 4,428,477 | A | | 1/1984 | Cristofolo |
| 4,448,704 | A | | 5/1984 | Barby et al. |
| RE31,885 | E | | 5/1985 | Meitner |
| 4,515,703 | A | | 5/1985 | Haq |
| 4,518,694 | A | | 5/1985 | Shaer |
| 4,565,644 | A | | 1/1986 | Smith et al. |
| 4,600,620 | A | | 7/1986 | Lloyd et al. |
| 4,601,938 | A | | 7/1986 | Deacon et al. |
| 4,624,890 | A | * | 11/1986 | Lloyd et al. ..... 442/93 |
| 4,652,389 | A | | 3/1987 | Moll |
| 4,666,621 | A | | 5/1987 | Clark et al. |
| 4,666,624 | A | | 5/1987 | Irlam et al. |
| 4,673,523 | A | | 6/1987 | Smith et al. |
| 4,683,001 | A | | 7/1987 | Floyd et al. |
| 4,725,489 | A | | 2/1988 | Jones et al. |
| 4,753,844 | A | | 6/1988 | Jones et al. |
| 4,772,501 | A | | 9/1988 | Johnson et al. |
| 4,784,786 | A | | 11/1988 | Smith et al. |
| 4,797,310 | A | | 1/1989 | Barby et al. |
| 4,833,003 | A | | 5/1989 | Win et al. |

(Continued)

FOREIGN PATENT DOCUMENTS

| | | | |
|---|---|---|---|
| EP | 1447041 | A1 | 8/2004 |
| WO | WO 94/16051 | | 7/1994 |
| WO | WO 97/00992 | | 1/1997 |
| WO | WO 97/29178 | | 8/1997 |
| WO | WO 97/32004 | | 9/1997 |
| WO | WO 98/05814 | | 2/1998 |
| WO | WO 01/45615 | A1 | 6/2001 |

(Continued)

OTHER PUBLICATIONS

U.S. Appl. No. 11/401,810, Apr. 11, 2006, Clark et al.
U.S. Appl. No. 11/513,718, Aug. 31, 2006, Michels et al.
U.S. Appl. No. 29/255,270, Mar. 7, 2006, Norcom et al.

*Primary Examiner* — Lorna M Douyon

(74) *Attorney, Agent, or Firm* — Julie A. McConihay; Leonard W. Lewis; Steven W. Miller

(57) ABSTRACT

Premoistened wipes for household use. The wipes are disposable. The wipes may be used to treat household surfaces including fabric-based surfaces. The wipes may include microencapsulated materials such as perfume and/or other benefit agents. The present invention also relates to a method for treating household surfaces utilizing the wipes of the present invention.

4 Claims, 2 Drawing Sheets

U.S. PATENT DOCUMENTS

| | | | | |
|---|---|---|---|---|
| 4,878,775 | A | 11/1989 | Norbury et al. | |
| 4,891,265 | A | 1/1990 | Samagalsky | |
| 4,906,396 | A | 3/1990 | Falholt et al. | |
| 4,998,984 | A | 3/1991 | McClendon | |
| 5,037,485 | A | 8/1991 | Chromecek et al. | |
| 5,342,534 | A | 8/1994 | Skrobala et al. | |
| 5,344,007 | A | 9/1994 | Nakamura et al. | |
| 5,507,968 | A | 4/1996 | Palaikis | |
| 5,547,476 | A | 8/1996 | Siklosi et al. | |
| 5,595,786 | A | 1/1997 | McBride, Jr. et al. | |
| 5,630,847 | A | 5/1997 | Roetker | |
| 5,656,361 | A | 8/1997 | Vogt et al. | |
| 5,849,039 | A | 12/1998 | Sadlowski | |
| 5,865,851 | A | 2/1999 | Sidoti et al. | |
| 5,895,504 | A | 4/1999 | Sramek et al. | |
| 5,908,473 | A | 6/1999 | Weller et al. | |
| 6,020,300 | A | 2/2000 | Tcheou et al. | |
| 6,048,368 | A | 4/2000 | Tcheou et al. | |
| 6,171,345 | B1 | 1/2001 | Convents et al. | |
| 6,177,395 | B1 | 1/2001 | Silvaggi et al. | |
| 6,233,771 | B1 | 5/2001 | Hortel et al. | |
| 6,262,009 | B1 | 7/2001 | Rogers et al. | |
| 6,277,808 | B1 | 8/2001 | Tcheou et al. | |
| 6,305,046 | B1 | 10/2001 | Kingry et al. | |
| 6,484,346 | B2 | 11/2002 | Kingry et al. | |
| 6,486,099 | B2 * | 11/2002 | Igari et al. | 504/359 |
| 6,579,023 | B2 * | 6/2003 | Kunkler et al. | 401/138 |
| 6,651,290 | B2 | 11/2003 | Kingry et al. | |
| 6,828,014 | B2 * | 12/2004 | Branham et al. | 428/311.11 |
| 2002/0174500 | A1 | 11/2002 | Micciche et al. | |
| 2003/0028165 | A1 * | 2/2003 | Curro et al. | 604/378 |
| 2003/0139320 | A1 | 7/2003 | Catalan et al. | |
| 2003/0216272 | A1 | 11/2003 | Sherry et al. | |
| 2003/0224030 | A1 * | 12/2003 | Uchiyama et al. | 424/405 |
| 2004/0226123 | A1 | 11/2004 | Policicchio et al. | |
| 2006/0052269 | A1 | 3/2006 | Panandiker et al. | |

FOREIGN PATENT DOCUMENTS

| | | |
|---|---|---|
| FR | 2575058 | 12/1985 |
| JP | 52-002069 | 6/1975 |
| JP | 62-243900 | 4/1986 |

* cited by examiner

METHOD FOR CLEANING HOUSEHOLD FABRIC-BASED SURFACE WITH PREMOISTENED WIPE

CROSS REFERENCE TO RELATED APPLICATIONS

This application claims the benefit of U.S. Provisional Application Ser. Nos. 60/685,815 filed on May 31, 2005 and 60/731,718 filed Oct. 31, 2005 and is a continuation-in-part of U.S. application Ser. No. 11/216,836 filed Aug. 31, 2005 which claims the benefit of U.S. Provisional Application Ser. No. 60/606,820 filed Sep. 1, 2004.

FIELD

The present invention relates to premoistened wipes for household use. The invention also relates to premoistened wipes which include compositions comprising microencapsulates. The present invention further relates to a method for cleaning household materials utilizing the premoistened wipes of the present invention.

BACKGROUND

One difficulty associated with utilizing wipes for cleaning fabric-based materials around the house is that in many instances the wipes are too harsh on the fabric, they fray, lint, or fall apart during usage, and/or they do not effectively remove surface dirt and contamination from the fabric.

For instance, it is known to impregnate a cleaning solution that includes water, a volatile cleaning agent, and a surfactant into a wipe formed from hydrophobic materials such as nylon and polyester. The wipe may also include a hydrophobic binder such as an acrylic latex binder. One drawback of this is that given its hydrophobic nature, the wipe will have inadequate capacity to hold cleaning solution. Another drawback is that the wipe is unable to adequately transfer the cleaning liquid to the fabric. Yet further, this type of system tends to disperse the dirt and contamination on and/or into the fabric rather than actually remove it from the fabric.

The present invention addresses these drawbacks by providing a premoistened disposable wipe which effectively removes surface dirt and contamination without leaving behind lint while being gentle on the fabric.

Another advantage of the present invention is the ability to deliver one or more of the premoistened disposable wipe's active materials/benefit agents (including but not limited to perfume) to the fabric in a microencapsulated form. While not wishing to be limited by theory, it is thought that upon delivery to the fabric, some of the microencapsulates may rupture providing an immediate release of the active material/benefit agent while some of the microencapsulates will not rupture until a later time thereby providing a delayed release of the active material/benefit agent which in turn provides additional opportunities for the active material/benefit agent to work after the fabric has been contacted by the wipe.

A further advantage of the present invention is the stability of the microencapsulates when used in conjunction with a premoistened wipe. A common occurrence when utilizing microencapsulates in conjunction with a premoistened wipe has been the tendency for the moistening composition of the wipe to weaken the microencapsulate. This leads to leakage and premature rupture of the microencapsulate thereby causing premature release of the microencapsulate contents prior to wipe use. The present invention helps to eliminate this problem.

These and other features, aspects, advantages, and variations of the present invention will become evident to those skilled in the art from a reading of the present disclosure with the appended claims and are covered within the scope of the claims.

SUMMARY

The present invention relates to a premoistened disposable wipe for cleaning household surfaces including but not limited to carpet, upholstery, flooring, tile, and countertops. The wipe comprises a substrate which is comprised of at least one ply which includes a composition applied to the substrate wherein the composition is applied to the substrate in the amount of from about 0.5 grams of the composition/gram of the substrate by weight to about 8 grams of the composition/gram of the substrate by weight. The composition may comprise:

i) from about 0.05% to about 15% by weight of an organic solvent;

ii) from about 0.01% to about 10% by weight of a microencapsulate; and iii) balance water.

The microencapsulate may include an active material such as perfume. A flocculating polymer in the amount of from about 0.001% to about 0.5% by weight may optionally be included. A detersive surfactant in the amount of from about 0.001% to about 2% by weight may optionally be included. The wipe may also comprise a layered laminate substrate, a composition, and microencapsulates. The composition comprises:

i) from about 0.05% to about 15% by weight of an organic solvent;

ii) from about 0.01% to about 10% by weight of a microencapsulate; and iii) balance water.

The microencapsulates may include perfume or alternatively one or more other active materials, or a combination thereof. If desired, the wipe can be apertured wherein the average area of each aperture is from about 0.01 $mm^2$ to about 4 $mm^2$. The open area of the substrate typically comprises from about 2% to about 25% of the substrate. The substrate has a fuzz level of less than about 0.8 $mg/cm^2$.

DETAILED DESCRIPTION

Figure 1:
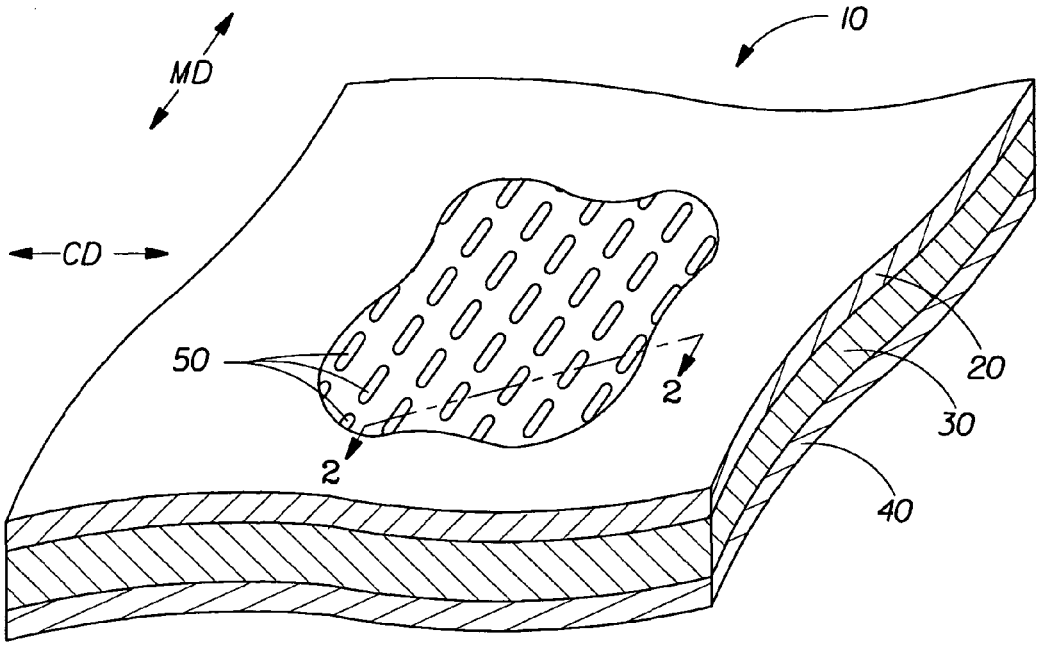
FIG. 1 is a perspective view of one embodiment of a premoistened wipe substrate made in accordance with the present invention.

Reference will now be made in detail to various embodiments of the present invention, examples of which are illustrated in the accompanying drawings wherein like numerals indicate the same elements throughout the views. All percentages, ratios and proportions herein are on a weight basis unless otherwise indicated.

Except as otherwise noted, all amounts including quantities, percentages, portions, and proportions, are understood to be modified by the word "about", and amounts are not intended to indicate significant digits.

Except as otherwise noted, the articles "a", "an", and "the" mean "one or more".

As used herein, "comprising" means that other steps and other ingredients which do not affect the end result can be added. This term encompasses the terms "consisting of" and "consisting essentially of". The compositions and methods/processes of the present invention can comprise, consist of, and consist essentially of the essential elements and limitations of the invention described herein, as well as any of the additional or optional ingredients, components, steps, or limitations described herein.

As used herein the term "fabric" encompasses articles of fabric including but not limited to: clothing, upholstery, linen, draperies, clothing accessories, leather, floor coverings, and the like. The term also encompasses other items made in whole or in part of fabric, including but not limited to tote bags, furniture covers, leather upholstery and other leather products, automobile interiors, tarpaulins, shoes, and the like.

As used herein, the term "premoistened" refers to the addition of a liquid to the substrate prior to use. The term "liquid" includes any material having a liquid phase, including but not limited to emulsions having a liquid phase. The substrate may be premoistened with liquid during manufacture or it may be premoistened with liquid after manufacture (e.g.; by the user at point of use).

As used herein, the term "disposable" is used to describe articles which are not intended to be laundered or otherwise restored but rather are intended to be discarded after use.

As used herein, the term "nonwoven" refers to a substrate that has a structure of individual fibers or threads which are interlaid, but not in any regular or repeating manner. Nonwoven substrates may be formed by a variety of processes including but not limited to meltblowing processes, spunbonding processes, and bonded carded processes.

As used herein, the term "microfibers", refers to small diameter fibers having an average diameter not greater than about 100 microns.

As used herein, the term "meltblown fibers", refers to fibers formed by extruding a molten thermoplastic material through a plurality of fine, usually circular, die capillaries as molten threads or filaments into a high velocity gas (e.g., air) stream which attenuates the filaments of molten thermoplastic material to reduce their diameter, which may be to a microfiber diameter. Thereafter, the meltblown fibers are carried by the high velocity gas stream and are deposited on a collecting surface to form a web of randomly dispersed meltblown fibers.

As used herein, the term "spunbonded fibers", refers to small diameter fibers which are formed by extruding a molten thermoplastic material as filaments from a plurality of fine, usually circular, capillaries of a spinneret with the diameter of the extruded filaments then being rapidly reduced by drawing.

As used herein, "laminate" and "composite" are used interchangeably to describe substrates which may be used with the present invention. Both refer to a substrate formed from at least two webs joined in a face to face relationship to form a unitary web comprised of more than one ply or layer.

As used herein, the terms "microcapsule" and "microencapsulate" are used interchangeably to describe small capsules, typically having a diameter of less than 1000 microns which contain an active material, one non-limiting example of which is a perfume.

As used herein, the term "polymer" generally includes, but is not limited to, homopolymers, copolymers, such as, for example, block, graft, random and alternating copolymers, terpolymers, etc., and blends and modifications thereof. Furthermore, unless otherwise specifically limited, the term "polymer" shall include all possible geometrical configurations of the material. These configurations include, but are not limited to, isotactic, syndiaotactic and random symmetries.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Premoistened Disposable Wipe

The premoistened disposable wipe of the present invention comprises a substrate and a composition which is applied thereto.

A. Substrate

The substrate of the present invention may be any suitable wipe substrate including but not limited to baby wipes, cleaning wipes, towelettes, and the like. The substrate of the present invention may be made in accordance with (but not limited to): PCT Publication No. WO 2004/080265 published in the name of Hofte et al. on Sep. 23, 2004; U.S. Publication No. 2006/0052269 published in the name of Panandiker et al. on Mar. 9, 2006; U.S. Pat. No. 6,716,805 issued to Sherry et al. on Apr. 6, 2004, U.S. Pat. No. 6,561,354 issued to Fereshtehkhou et al. on May 13, 2003; U.S. Publication No. 2003/0028165 published in the name of Curro et al. on Feb. 6, 2003 and U.S. Publication No. 2002/0034912 published in the name of Curro et al. on Mar. 21, 2002. The substrate of the present invention may be comprised of one or more plies. The substrate may comprise woven and/or nonwoven, unmodified and/or modified natural fibers (one non-limiting example of which is a cellulosic-based fiber such as wood pulp fiber), synthetic fibers, or mixtures thereof.

Other natural fibers which may be used include but are not limited to cotton, Esparto grass, bagasse, hemp, flax, silk, wool, wood pulp, chemically modified wood pulp, jute, ethyl cellulose, and/or cellulose acetate. Suitable synthetic fibers include but are not limited to polyvinyl chloride, polyvinyl fluoride, polytetrafluoroethylene, polyvinylidene chloride, polyacrylics such as ORLON®, polyvinyl acetate, rayon, polyethylvinyl acetate, non-soluble or soluble polyvinyl alcohol, polyolefins such as polyethylene (e.g., PULPEX®) and polypropylene, polyamides such as nylon, polyesters such as DACRON® or KODEL®, polyurethanes, polystyrenes, and the like, including fibers comprising polymers containing more than one monomer.

The fibers useful herein can be hydrophilic, hydrophobic, or can be a combination of both hydrophilic and hydrophobic fibers. As indicated above, the particular selection of hydrophilic or hydrophobic fibers depends upon the other materials included in the absorbent (and to some degree) the scrubbing layer described hereinafter. Suitable hydrophilic fibers for use in the present invention include cellulosic fibers, modified cellulosic fibers, rayon, cotton, polyester fibers such as hydrophilic nylon (HYDROFIL®). Suitable hydrophilic fibers can also be obtained by hydrophilizing hydrophobic fibers, such as surfactant-treated or silica-treated thermoplastic fibers derived from, for example, polyolefins such as polyethylene, polypropylene, polyacrylics, polyamides, polystyrenes, polyurethanes and the like.

Suitable wood pulp fibers include those obtained from well-known chemical pulping processes such as the kraft and sulfite processes. It may be desirable to derive these wood pulp fibers from southern softwoods due to their premium absorbency characteristics. These wood pulp fibers can also be obtained from mechanical pulping processes, such as stone groundwood, refiner mechanical, thermomechanical, chemimechanical, and chemithermomechanical pulping processes. Recycled or secondary wood pulp fibers, as well as bleached and unbleached wood pulp fibers, can also be used.

Another type of hydrophilic fiber which may be used in the present invention is chemically stiffened cellulosic fiber. As used herein, the term "chemically stiffened cellulosic fiber" means cellulosic fibers that have been stiffened by chemical means to increase the stiffness of the fibers under both dry and aqueous conditions. Such means can include the addition of a chemical stiffening agent that, for example, coats and/or impregnates the fibers. Such means can also include the stiffening of the fibers by altering the chemical structure, e.g., by crosslinking the polymer chains.

If fibers are used as the absorbent layer (or a constituent component thereof), the fibers can optionally be combined with a thermoplastic material. Upon melting, at least a portion of this thermoplastic material migrates to the intersections of the fibers, typically due to interfiber capillary gradients. These intersections become bond sites for the thermoplastic material. When cooled, the thermoplastic materials at these intersections solidify to form the bond sites that hold the matrix or substrate of fibers together in each of the respective layers. This can be beneficial in providing additional overall integrity to the cleaning wipe.

Various methods can be used to form a suitable substrate for use in the present invention. Suitable methods include but are not limited to spunbonding, meltblowing, carding, wet laying, and airlaying. Suitable techniques for binding the fibers of the substrate together include but are not limited to hydroentangling, needle punching, thermal bonding, ultrasonic bonding, chemical bonding, surface treating, and laminating.

When utilizing a substrate comprised of more than one ply, wherein one of the plies is an absorbent layer, the fibers can optionally be combined with a thermoplastic material. Upon melting, at least a portion of this thermoplastic material migrates to the intersections of the fibers, typically due to interfiber capillary gradients. These intersections become bond sites for the thermoplastic material. When cooled, the thermoplastic materials at these intersections solidify to form the bond sites that hold the matrix or substrate of fibers together in each of the respective plies. This may be beneficial in providing additional overall integrity to the wipe.

Thermoplastic materials useful in the present invention can be in any of a variety of forms including particulates, fibers, or combinations thereof. Suitable thermoplastic materials can be made from any thermoplastic polymer that can be melted at temperatures that will not extensively damage the fibers that comprise the primary substrate or matrix of each ply. Typically, the melting point of this thermoplastic material will be less than about 190° C., and generally between about 50° C. and about 175° C.

Suitable thermoplastic fibers can be made from a single polymer (monocomponent fibers), or can be made from more than one polymer (e.g., bicomponent fibers). As used herein, "bicomponent fibers" refers to thermoplastic fibers that comprise a core fiber made from one polymer that is encased within a thermoplastic sheath made from a different polymer. The polymer comprising the sheath often melts at a different, typically lower, temperature than the polymer comprising the core. As a result, these bicomponent fibers provide thermal bonding due to melting of the sheath polymer, while retaining the desirable strength characteristics of the core polymer.

Suitable bicomponent fibers for use in the present invention can include sheath/core fibers having the following polymer combinations: polyethylene/polypropylene, polyethylvinyl acetate/polypropylene, polyethylene/polyester, polypropylene/polyester, copolyester/polyester, and the like. Particularly suitable bicomponent thermoplastic fibers for use herein are those having a polypropylene or polyester core, and a lower melting copolyester, polyethylvinyl acetate or polyethylene sheath (e.g., those available from Danaklon a/s, Chisso Corp., and CELBOND®, available from Hercules). These bicomponent fibers can be concentric or eccentric. As used herein, the terms "concentric" and "eccentric" refer to whether the sheath has a thickness that is even, or uneven, through the cross-sectional area of the bicomponent fiber. Eccentric bicomponent fibers may be desirable in providing more compressive strength at lower fiber thicknesses.

Suitable methods for preparing thermally bonded fibrous materials are described in U.S. Pat. No. 5,607,414 issued to Richards et al. on Mar. 4, 1997 and U.S. Pat. No. 5,549,589 issued to Homey et al. on Aug. 27, 1996.

Another method of bonding the fibers is chemical bonding. Common chemical bonding agents include but are not limited to solvent based and resin based adhesives (e.g.; latex, etc.).

The wipe may also be comprised of a HIPE-derived hydrophilic, polymeric foam. Such foams and methods for their preparation are described in U.S. Pat. No. 5,550,167 issued to DesMarais on Aug. 27, 1996.

The substrate of the present invention typically has a basis weight of about 40 grams/m$^2$ to about 250 grams/m$^2$ or from about 50 gram/m$^2$ to about 120 grams/m$^2$ as measured in accordance with ASTM D3776-96 and a caliper of from about 0.3 mm to about 2 mm. The substrate of the present invention has a liquid holding capacity of about 1 gram of liquid/gram of substrate to about 10 grams of liquid/gram of substrate, or about 2 grams of liquid/gram of substrate to about 8 grams of liquid/gram of substrate, or about 3 grams of liquid to about 5 grams of liquid/gram of substrate and has a fuzz level of less than about 0.8 mg/cm$^2$, or less than about 0.5 mg/cm$^2$, or less than about 0.3 mg/cm$^2$. The substrate has a dry cross direction ("CD") stiffness value of from about 0.01 g-cm to about 2 g-cm and a wet cross direction stiffness value of from about 0.005 g-cm to about 2 g-cm, or from about 0.1 g-cm to about 1.5 g-cm.

In one non-limiting embodiment, the substrate can be an airlaid nonwoven fibrous substrate comprising a combination of natural fibers, staple length synthetic fibers and a latex adhesive binder. The dry fibrous substrate can be about 20% to 80% by weight wood pulp fibers, about 10% to 60% by weight staple length polyester fibers, and about 10% to 25% by weight binder.

In another non-limiting embodiment, the dry fibrous substrate can comprise at least about 50% by weight wood pulp fibers, and more preferably at least about 70% by weight wood pulp fibers. One particular airlaid nonwoven fibrous substrate which is suitable for use in the present invention comprises about 75% by weight Southern softwood Kraft wood pulp fibers having an average fiber length of about 2.6 mm; about 12% by weight polyester fibers having a denier of about 1.35 grams per 9000 meters of fiber length and a staple length of about 0.85 inch; and about 13% by weight of a binder composition comprising a styrene butadiene copolymer. The styrene butadiene copolymer may have a styrene to butadiene ratio of about 45 parts styrene to 55 parts butadiene. A latex adhesive suitable for making the binder composition is ROVENE 5550 (containing about 50 weight percent solids of styrene butadiene copolymer) available from Mallard Creek Polymers of Charlotte, N.C.

In a further non-limiting embodiment the substrate of the present invention is formed by air laying a blend of natural and synthetic fibers to form a fibrous web, spraying water on the web, and then embossing the web. A latex adhesive binder is then applied to the web, followed by drying and curing of the latex adhesive binder in an oven. The nonwoven web is then premoistened with a liquid.

In yet another non-limiting embodiment the substrate is a laminate substrate formed from a laminate web 10 comprising at least three layers or plies, disposed in a layered, face-to-face relationship, as shown in FIG. 1. The layers should be sufficiently thin to be processible such as described in U.S. Publication No. 2003/0028165, but no actual thickness (i.e., caliper) is considered limiting. A first outer layer 20, is typically thermally bondable, and may be a nonwoven web comprising a sufficient quantity of thermoplastic material, the web having a predetermined extensibility and elongation to break. By "sufficient quantity" is meant a quantity of thermoplastic material adequate to enable enough thermal bonding upon application of heat and/or pressure to produce a unitary web. A second outer layer, 40, is typically the same material as first outer layer 20, but may be a different material. Second outer layer, 40 is also generally thermally bondable and has a predetermined extensibility and elongation to break. At least one third central layer 30 may be disposed between the two outer layers. The laminate web 10 is processed by joining means, such as by ultrasonic welding, or thermal calendaring as described in U.S. Publication No. 2003/0028165 to provide a plurality of melt bond sites 50 that serve to couple the outer layers 20 and 40, and, in some embodiments, portions of central layer 30, thereby forming the constituent layers into a unitary web. When joined together, the two outer layers form an interior region between them. The interior region is the space between the outer layers surrounding the bond sites 50. In one non-limiting embodiment, the third central layer 30 substantially fills the interior region, the third central layer 30 being apertured coincident the bond sites 50.

While the laminate web 10 is disclosed primarily in the context of nonwoven webs and composites, in principle the laminate web 10 can be made out of any web materials that meet the requirements, (e.g., melt properties, extensibility) as disclosed herein. For example, the outer layers 20 and 40 can be thermoplastic films, micro-porous films, apertured films, and the like. Central layer 30 can be paper, including tissue paper; metal, including metal foil; other non-thermoplastic web material, woven fabric, and the like. In general, it is required that outer layer materials be flexible enough to be processed as described herein. However, central layer can be a brittle, relatively stiff material, as long at it also can be processed as described herein, albeit possibly becoming fractured, broken, or otherwise broken up in the process.

The laminate substrate may be apertured, non-apertured, or a combination thereof. The laminate substrate may have an average aperture size of from about 0.01 $mm^2$ to about 4 $mm^2$ or from about 0.5 $mm^2$ to about 2.5 $mm^2$. The percentage of the laminate which is comprised of apertures may be express as the percent open area. The percent open area of the laminate of the present invention may be from about 2% to about 25% or from about 5% to about 20%. In one non-limiting embodiment as shown in cross-section in FIG. 2, central layer 30 can be apertured, without aperturing the two outer layers to provide a three-layer laminate characterized by the laminate web 10 (as a whole) being unapertured, while the central layer 30 is apertured. The laminate substrate web can be made without requiring registration of the layers to ensure bonding of the outer layers through the apertures of the central layer(s). One way of describing one embodiment of a web 10 as described above, is that the unitary web 10, when viewed orthogonally by the un-aided human eye from a distance of approximately 50 cm, exhibits no apertures or perforations through the entire laminate, but bond sites 50 are nevertheless visible.

The laminate web 10 is further characterized in that the joining of the three plies into a unitary web can be achieved in the absence of adhesive. Thus in some embodiments no adhesive is required to bond the plies together. Joining is achieved by the input of energy into the constituent layers, such as by thermal melt bonding of the two outer layers together at the melt bond sites 50. In other embodiments, the energy input can be via ultrasonic bonding. Accordingly, a laminate web, that is a unitary web, can be formed without the use of adhesives. Not only does this simplify processing and lower the cost of the laminate web, when certain materials such as nonwoven webs are used, it results in a more flexible, softer web.

Figure 2:
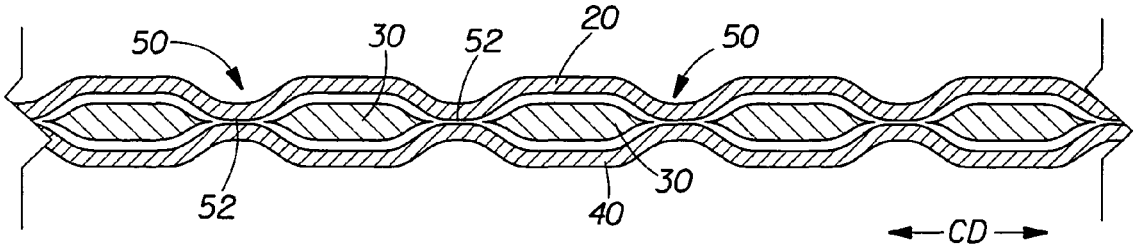
FIG. 2 is a cross-sectional view of a portion of the wipe substrate of FIG. 1.

As shown in FIG. 2, central layer 30 is chosen such that when the constituent web layers of laminate web 10 are processed by the method of the present invention, portions of central layer 30 in the region of the melt bond sites 50 separate to permit the first outer layer 20 to melt bond directly to the second outer layer 40 at the interface of the two materials 52 at melt bond sites 50. Thus, apertures in the central layer 30 are formed in the lamination step by displacement, just prior to the bonding of the outer layers as detailed by the method of the present invention below. In this manner, central layer 30 can be provided as an unapertured web, avoiding complex registration steps to align apertures in registry with bond sites when laminated. Further, central layer 30 need not be thermally compatible with outer layers 20 and 40. Central layer need not be a thermoplastic material, and need not even have a melting point. It simply needs to be displaceable by the forces exerted by the processing equipment. By "conductive properties" as used herein it is meant electrically conductivity, such that the central layer can have an electrical conductivity that is about 10 times as great as the outer layers or about 100 or more times as great as the outer layers. Conductive properties may be facilitated by the central layer being a metallic foil, or by being a conductive polymer, including a conductive nonwoven web.

Figure 3:
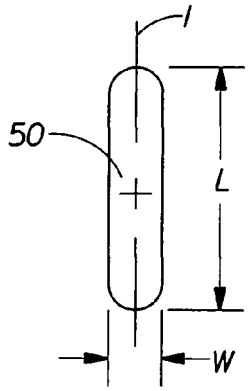
FIG. 3 is a magnified detail view of one bond site of a laminate substrate made in accordance with the present invention.

Without being bound by theory, it is believed that to accomplish the displacement of central layer 30 to form apertures therein and to bond the outer layers, the thermal point calendaring as described in U.S. Publication No. 2003/0028165 should form thermal bond sites having a narrow width W dimension and a high aspect ratio. For example, FIG. 3 shows the melt area of a single melt bond site 50 having a narrow width dimension W and a high aspect ratio, i.e., the length, L, is much greater than the width, W. The length L should be selected to permit adequate bond area while width W is sufficiently narrow such that the protuberance used to form the bond site (as described below) can cut, shear, displace, or otherwise pierce the central layer 30 at the region of the bond sites by the method described below. Width W can be between about 0.003 inches (0.008 cm) and about 0.020 inches (0.050 cm) or between about 0.005 inches (0.012 cm) and about 0.010 inches (0.025 cm), and may be adjusted depending on the properties of central layer 30.

It is believed that the aspect ratio of melt bond site 50 can be as low as about 3 (i.e., ratio of L/W equals 3/1). It can also be between about 4 and 20. It is believed that the aspect ratio of the melt bond sites 50 is limited only by the corresponding aspect ratio of the point bonding protuberances of the calendaring roller(s), as disclosed in U.S. Publication No. 2003/0028165.

In one embodiment, the longitudinal axis of each bond site, I, which corresponds directionally to the length dimension of bond site 50, is disposed in a regular, repeating pattern oriented generally parallel to the machine direction, MD as shown in FIG. 1. But the longitudinal axis of each bond site may be disposed in a regular, repeating pattern oriented in the cross machine direction, or randomly oriented in a mixture of cross and machine directions. In one non-limiting example, the bond sites 50 can be disposed in a "herringbone" pattern.

Figure 4:
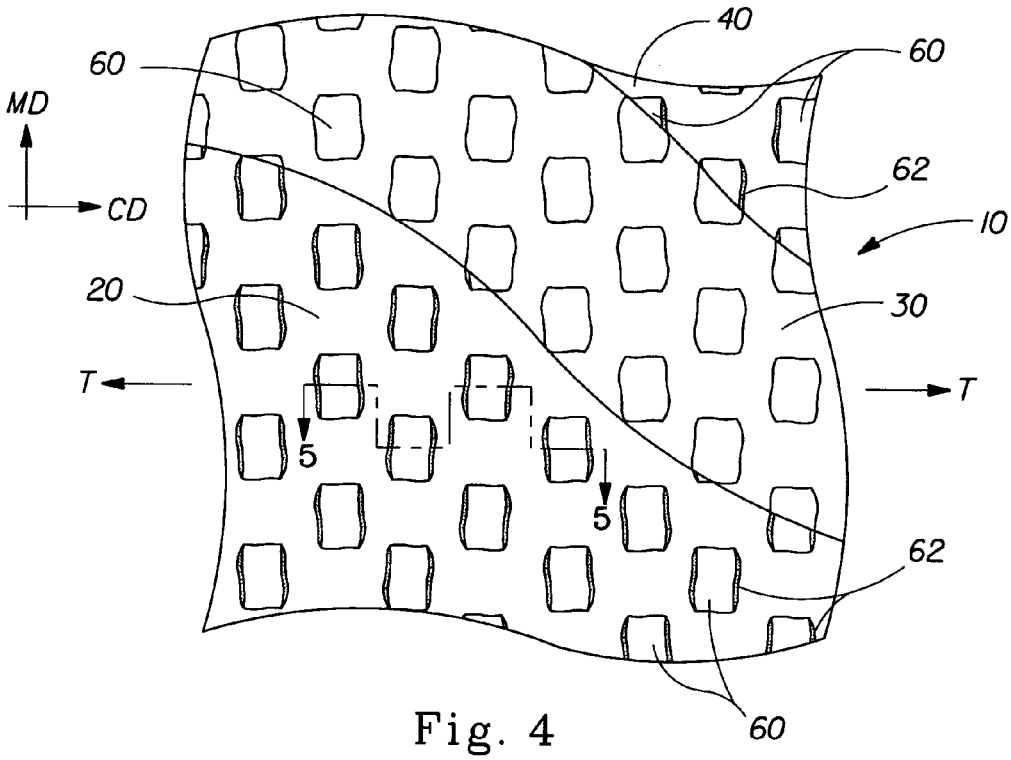
FIG. 4 is a top plan view of another embodiment of a substrate made in accordance with the present invention.

FIG. 4 shows a partially cut-away representation of an apertured laminate. As shown, the partial cut-away permits each layer or ply to be viewed in a plan view. The laminate web 10 shown in FIG. 4 is produced after the thermally bonded laminate is stretched in a direction orthogonal to the longitudinal axis of the melt bond sites, in this case, in the cross-machine direction, CD with sufficient elongation in the direction of extension to cause apertures to form. As shown, where formerly there were melt bond sites 50, apertures 60 are produced as the relatively weak bond sites fail in tension. Also as shown, central layer 30 can remain generally uniformly distributed within laminate 10, depending on the material properties of central layer 30. For example, if central layer 30 is more extensible than outer layers 20 or 40, then it simply extends, either elastically or by plastic deformation, but remains generally uniformly distributed in the unapertured regions of web 10. For example, if a thermoplastic film is utilized as the central layer 30, it extends, either extensibly or elastically (depending on the type of film), but can remain generally uniform, for example, in density or basis weight.

One beneficial property of such a laminate web is that once apertured, fluid communication with the central layer is facilitated. Thus, an absorbent central layer 30 can be used between two relatively non-absorbent outer layers, and the laminate 10 could be an absorptive wiper with a relatively dry to the touch outer surface.

To the extent that central layer 30 is involved, or participates, in any bonding between outer layers 20 and 40, it also participates in the remnant of bonded portions 62, as shown in FIG. 4. The involvement may be due to some degree of actual melt bonding about the perimeter of bond site 50 (e.g., for thermoplastic central layers 30), or it may be due to mechanical interaction, such as by entanglement (e.g., for cellulosic fibrous central layer 30 between fibrous nonwoven layers).

Figure 5:
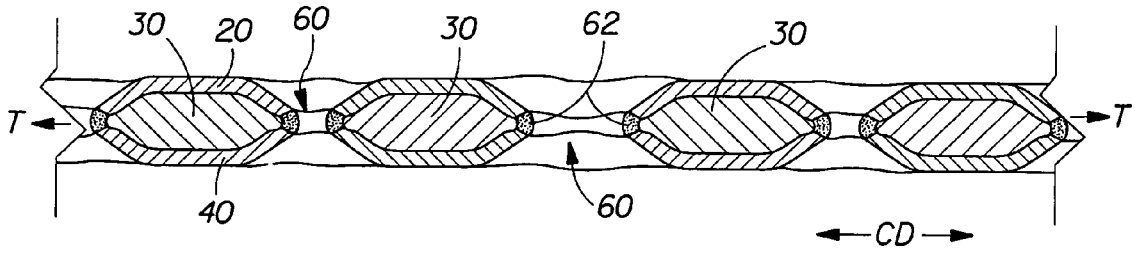
FIG. 5 is a cross-sectional view of a portion of the substrate shown in FIG. 4.

FIG. 5 is a schematic representation of the cross-section denoted in FIG. 4. As shown, apertures 60 form when the laminate web is elongated in the direction T.

An example of one embodiment of a unitary web having a central layer having an elongation to break less than either of the two outer layers, and less than the actual magnitude of extension, is shown partially cut-away in FIG. 5. The partial cut-away permits each layer or ply to be viewed in a plan view. As shown, after extension, central layer 30 becomes fragmented, forming discontinuous regions of the central layer material. These discontinuous regions may be relatively uniformly distributed, such as in rows as shown in FIG. 5, or may be relatively randomly distributed, depending on the pattern of melt bond sites 50, the physical properties of central layer 30, and the method of extension employed.

One example of a web 10 having a structure similar to that shown in FIG. 5 is a web having outer layers of relatively extensible nonwovens, with a central layer of relatively low extensibility tissue paper. Such a laminate would be an apertured laminate web having an absorbent central core, wherein the absorbent core material is in fluid communication with regions exterior to the laminate web. If a relatively hydrophobic nonwoven web is used for the outer layers, such a wipe could exhibit dry-to-the-touch properties along with high absorbency.

One example of a web 10 having a structure similar to that shown in FIG. 5 is a web having outer layers of relatively extensible nonwovens, with a central layer of relatively low extensibility tissue paper. One particularly interesting structure incorporates a highly hydrophobic outer layer combined with a highly absorbent central layer. A suitable hydrophobic material is described in U.S. Pat. No. 3,354,022 Dettre et al. Such a material has a water repellent surface having an intrinsic advancing water contact angle of more than 90 degrees and an intrinsic receding water contact angle of at least 75 degrees. Such a material exhibits highly hydrophobic properties, similar to the effect known to exist on leaves from the Lotus plant. When such a material is combined with an absorbent central layer, one non-limiting example of which is a BOUNTY® paper towel tissue layer, the resulting composite can be highly absorbent while retaining a very clean and dry outer surface. The basis weight and porosity of the outer layer can be varied to achieve different degrees of absorbent performance.

Other webs and methods of making webs suitable for use in the present invention include but are not limited to those described in the following patents the disclosures of which are incorporated herein by reference: U.S. Pat. No. 3,862,472 issued Jan. 28, 1975 to Norton et al.; U.S. Pat. No. 3,905,863, issued Sep. 16, 1975 to Ayers; U.S. Pat. No. 3,974,025 issued Aug. 10, 1976 to Ayers; U.S. Pat. No. 3,918,126 issued Nov. 11, 1975 to Wood; U.S. Pat. No. 3,982,302 issued Sep. 28, 1976 to Vaalburg; U.S. Pat. No. 4,004,323 issued Jan. 25, 1977 to Gotchel et al.; U.S. Pat. No. 4,014,635 issued Mar. 29, 1977 to Kroyer; U.S. Pat. No. 4,057,669 issued Nov. 8, 1977 to McConnell; U.S. Pat. No. 4,064,600 issued Dec. 27, 1977 to Gotchel et al.; U.S. Pat. No. 4,074,393 issued Feb. 21, 1978 to Hicklin et al.; U.S. Pat. No. 4,097,965 issued Jul. 4, 1978 to Gotchel et al.; U.S. Pat. No. 4,130,915 issued Dec. 26, 1978 to Gotchel et al.; U.S. Pat. No. 4,144,619 issued Mar. 20, 1979 to White et al.; U.S. Pat. No. 4,176,426 issued Dec. 4, 1979; U.S. Pat. No. 4,176,427 issued Dec. 4, 1979 to Neuenschwander; U.S. Pat. No. 4,1919,609 issued Mar. 4, 1980 to Trokhan; U.S. Pat. No. 4,207,367 issued Jun. 10, 1980 to Baker, Jr.; U.S. Pat. No. 4,296,161 issued Oct. 20, 1981 to Kaiser et al., U.S. Pat. No. 4,309,469 issued Jan. 5, 1982 to Varona; PCT Publication No. WO 00/08998 published in the name of Hanser et al. on Feb. 24, 2000.

B. Composition

The substrate of the present invention is moistened with an aqueous liquid composition. Microencapsulated actives are included with the aqueous liquid composition. One or more actives may be contained within a single microencapsulate. Different active-containing microencapsulates may also be used. Examples of these actives include but are not limited to perfume, surfactant, silicone, antimicrobial agents, antiviral agents, antiallergenic/allergen control agents including but not limited to those disclosed in U.S. Patent Application Ser. No. 60/731,718 filed on Oct. 31, 2005 such as benzoic acid and 3,4,5-trimethoxybenzoic acid, emmolients, softening agents, conditioning agents, preservatives, and the like. From about 0.01% to about 10% by weight of the aqueous liquid composition may comprise microencapsulated active(s), or from about 0.025% to about 5% by weight of the aqueous liquid composition may comprise microencapsulated active(s), or from about 0.05% to about 1% by weight of the aqueous liquid composition may comprise microencapsulated active(s) (based on the weight of the microcapsule and the active contained therein).

If desired, the aqueous liquid composition may also be comprised of from about from about 0.05% to about 10% by weight of an organic solvent. The aqueous liquid composition may also optionally include from about 0.001% to about 0.5% by weight of a flocculating polymer, from about 0.01% to about 10% or from about 0.01% to about 2% by weight of a surfactant, and from about 0.001% to about 1% or from about 0.01% to about 0.5% by weight of perfume. From about 0.001% to about 10% or from about 0.01% to about 5% of other optional components may be included in the aqueous liquid composition including but not limited to silicone, antimicrobial agents, antiallergenic agents/allergen control agents including but not limited to those disclosed in U.S. Patent Application Ser. No. 60/731,718 filed on Oct. 31, 2005 such as benzoic acid and 3,4,5-trimethoxybenzoic acid, antiviral agents, emmolients, softening agents, conditioning agents, preservatives, perfume, and the like. The pH of the aqueous liquid composition typically ranges from about 4 to about 10.

The ratio of the mass of the liquid composition to the mass of the wipe substrate is in the range of from about 10:1 to about 1:1 or from about 6:1 to about 3:1. The aqueous liquid composition may be applied to the substrate in an amount from about 0.5 grams aqueous liquid composition/gram of substrate to about 8 grams aqueous liquid composition/gram of substrate or from about 3 grams aqueous liquid composition/gram of substrate to about 5 grams aqueous liquid composition/gram of substrate.

Without being bound by theory, it is believed that when used, the flocculating polymer is likely irreversibly adsorbed on the cellulosic component of the wipe so as to flocculate the dirt away from the surface being cleaned thereby holding the dirt and contaminants in the interior of the substrate. As the cellulosic layer forms the central ply of the web it is not in direct contact with the fabric being cleaned. This prevents the dirt from being smeared on the surface being cleaned. Further, when used, it is believed (while not wising to be limited by theory) that the organic solvent solubilizes the surface dirt and makes it easier to be removed. It may be desirable for the solvent to be nonvolatile under usage conditions. Being nonvolatile, the solvent allows sufficient working time before the fabric dries out. This allows the user sufficient time to clean the fabric before the composition dries thereby alleviating excessive reapplication of the composition.

While not wishing to bound by theory it is believed that it is undesirable to overload the wipe substrate with flocculating polymer as the polymer may have a tendency to be released onto the surface being cleaned thereby allowing for the dirt and contaminants to be flocculated/remain on the fabric being cleaned.

Microencapsulated Active

The present compositions comprise microcapsules or microencapsulates containing one or more active materials one non-limiting example of which is a perfume. The terms "microcapsules" and "microencapsulates" are used interchangeably herein. Other active materials which may be contained within the microcapsule include but are not limited to fungicides, odor control agents, antistatic agents, skin or hair conditioning agents, emmolients, softening agents, conditioning agents, preservatives, fluorescent whitening agents, antimicrobial actives, antiviral actives, antiallergenic/allergen control agents including but not limited to those disclosed in U.S. Patent Application Ser. No. 60/731,718 filed on Oct. 31, 2005 such as benzoic acid and 3,4,5-trimethoxybenzoic acid, antiviral agents, preservatives, UV protection agents, flame retardants, stain and water repellants, and the like.

Materials suitable for repelling stains have been described by E. Kissa in "*Functional Finishes Part B", Chemical Processing of Fibers and Fabrics*, published by Marcel Dekker. They include but are not limited to waxes, aluminum and zirconium soaps, silicones and flurochemical polymers. Preferred stain repellants are silicones and fluoropolymers and fluorosilicones. Commercially available examples of fluoropolymers include those sold commercially under the trade name SCOTCHGARD available from 3M Corporation of St. Paul, Minn. or REPEARL available from Mitsubishi Chemicals of Japan. The fluorosilicones are available from Grant Industries of Elmwood Park, N.J. under the trade name of GRANSIL and from Siltech Corporation of Toronto, Canada under the trade name FLUOROSIL.

The microcapsule in the composition can be any rupturable capsule containing an active material. The rupture strength of the microcapsule should be such that it does not rupture while it is being processed. While not wishing to be limited by theory, it is thought that upon delivery to the fabric, some of the microencapsulates may rupture providing an immediate release of the active material while some of the microencapsulates will not rupture until a later time thereby providing a delayed release of the active material which in turn provides additional opportunities for the active material to work after the fabric has been contacted by the wipe.

Encapsulation of perfume or other materials in small capsules (or microcapsules), typically having a diameter less than about 1000 microns, is well known. One type of capsule, referred to as a wall or shell capsule, comprises a generally spherical hollow shell of insoluble material, typically polymer material, within which the active material of perfume is contained.

The shell capsules may be prepared using a range of conventional methods known to those skilled in the art for making shell capsules such as coacervation, interfacial polymerization and poly-condensation. The process of coacervation typically involves encapsulation of a generally water-insoluble material by the precipitation of colloidal material(s) onto the surface of droplets of the material. Coacervation may be simple e.g. using one colloid such as gelatin, or complex where two or possibly more colloids of opposite charge, such as gelatin and gum arabic or gelatin and carboxymethyl cellulose, are used under carefully controlled conditions of pH, temperature and concentration. Coacervation techniques are described, e.g. in U.S. Pat. Nos. 2,800,458; 2,800,457; GB Patent No. 929,403; EP 385,534; and EP 376,385. It is recognized however that many variations with regard to materials and process steps are possible.

Interfacial polymerization produces encapsulated shells from the reaction of at least one oil-soluble wall forming material present in the oil phase with at least one water-soluble wall forming material present in the aqueous phase. A polymerization reaction between the two wall-forming materials occurs resulting in the formation of covalent bonds at the interface of the oil and aqueous phases to form the capsule wall. An example of a shell capsule produced by this method is a polyurethane capsule.

Polycondensation involves forming a dispersion or emulsion of water-insoluble material (a non-limiting example of which is perfume) in an aqueous solution of precondensate of polymeric materials under appropriate conditions of agitation to produce capsules of a desired size, and adjusting the reaction conditions to cause condensation of the precondensate by acid catalysis, resulting in the condensate separating from solution and surrounding the dispersed water-insoluble material fill to produce a coherent film and the desired microcapsules. Polycondensation techniques are described, in U.S. Pat. Nos. 3,516,941; 4,520,142; 4,528,226; 4,681,806; 4,145,184; GB Patent No. 2,073,132 and PCT Publication WO 99/17871. It is recognized however that many variations with regard to materials and process steps are possible.

Nonlimiting examples of materials suitable for making the shell of the microcapsule include urea-formaldehyde, melamine-formaldehyde, phenol-formaldehyde, gelatin, polyurethane, polyamides, cellulose esters including cellulose butyrate, acetate and cellulose nitrate, cellulse ethers like ethyl cellulose, polymethacrylates. Other encapsulation techniques are disclosed in *MICROENCAPSULATION: Methods and Industrial Applications*, Edited by Benita and Simon (Marcel Dekker, Inc., 1996).

One preferred method for forming shell capsules useful herein is polycondensation, which may be used to produce aminoplast encapsulates. Aminoplast resins are the reaction products of one or more amines with one or more aldehydes, typically formaldehyde. Non-limiting examples of suitable amines include urea, thiourea, melamine and its derivatives, benzoguanamine and acetoguanamine and combinations of amines. Suitable cross-linking agents (e.g. toluene diisocyanate, divinyl benzene, butane diol diacrylate etc.) may also be used and secondary wall polymers may also be used as appropriate, as described in the prior art e.g. anhydrides and their derivatives, particularly polymers and co-polymers of maleic anhydride as disclosed in PCT Publication W0 02/074430.

Preferably, the shell capsules are aminoplast capsules. More preferably the capsules are melamine-based, either alone or in combination with other suitable amines, crosslinking agents and secondary polymers. Particles and capsule diameter can vary from about 10 nanometers to about 1000 microns, or from about 50 nanometers to about 100 microns, or from about 1 micron to about 60 microns. The particle size distribution can be narrow, broad or multimodal.

The active materials used in the core can be a wide variety of materials which one would want to deliver in a controlled manner on to surfaces being treated with the present composition or into the environment surrounding the surfaces. Nonlimiting examples of active ingredients include perfumes, fungicides, odor control agents, antistatic agents, skin or hair conditioning agents, fluorescent whitening agents, antimicrobial actives, UV protection agents, flame retardants and the like.

In one non-limiting example the composition of the core material is a fragranced composition. The term "fragranced composition" is used to mean a composition containing at least about 0.1% by weight of one or more perfume materials. As is well known, a perfume normally consists of a mixture of a number of perfume materials, each of which has an odor or fragrance. The number of perfume materials in a perfume is typically 10 or more. The range of fragrant materials used in perfumery is very wide. The materials come from a variety of chemical classes, but in general are water insoluble oils. In many instances, the molecular weight of a perfume material is in excess of 150 Daltons, but does not exceed 300 Daltons. Perfumes used in the present invention can be mixtures of conventional perfume materials. Such perfume materials are mentioned, for example, in "*Perfume and Flavor Chemicals*", by S. Arctander (Montclair, N.J., 1969), in "*Perfume and Flavor Materials of Natural Origin*", by S. Arctander, (Elizabeth, N.J., 1960) and in "*Flavor and Fragrance Materials*", Allured Publishing Co., (Wheaton, Ill., 1991).

The shell capsules typically have a mean diameter in the range of about 0.1 microns to about 500 microns, or from about 1 micron to about 50 microns. Preferred sizes for the shell capsules will depend upon their intended use. If necessary, the shell capsules as initially produced may be filtered or screened to produce a product of greater size uniformity.

It is known to those skilled in the art that the perfume or other active ingredients from ordinary aminoplast capsules leak out during storage of the product. It is thought that when the capsules are mixed with aqueous mixture of solvent and/or surfactants, the solvents and/or surfactants can cause the perfume to leach out of the capsule. This is a particular problem when the encapsulated material is to some extent surfactant and/or solvent soluble e.g. perfume, as typically, the encapsulated material will be lost to the composition over a relatively short period of time. Wipes which contain a substantial amount of solvent and surfactants are subject to this problem.

Surprisingly, however, it has been observed that capsules which have been coated with a barrier polymer on the inner surface or the outer surface of the shell are more resistant to leakage. Such capsules are disclosed in PCT Publication WO 04/016234 and EP 1,407,754.

The coating may be applied to the outer surface of a shell capsule by a variety of conventional coating techniques including spraying, fluid bed coating, precipitating etc. For example a coating, typically of polymer, may be precipitated from aqueous solution to condense onto the outer surface of the capsule e.g. in the form of a capsule slurry, with precipitation being caused to occur e.g. by change of temperature, change of pH or addition of salt. The shell capsule to be coated is thus formed in a separate step, prior to the application of the coating to the outer surface of the shell wall. Depending on the composition of the outer surface coating, a coated shell capsule may be prepared for example, by coacervation or polycondensation. A coating may be partial or complete. Preferably, the one or more coatings are complete, so that the shell capsules are thus preferably substantially impermeable.

Suitable polymers for coating the outer wall of the shell include water soluble cationic polymers, amphoteric polymers with ratio of cationic and anionic functionalities resulting in a net positive charge, homo and copolymers of vinyl pyrrolidone, and copo poly(vinyl pyrrolidone/lymers of maleic anhydride.

Cationic polymers in general and their method of manufacture are known to one skilled in the art. For example, a detailed description of cationic polymers can be found in an article by M. Fred Hoover that was published in the "*Journal of Macromolecular Science-Chemistry*", A4(6), pp 1327-1417, October, 1970. Other suitable cationic polymers are those used as retention aids in the manufacture of paper. They are described in "*Pulp and Paper, Chemistry and Chemical Technology Volume III*", edited by James Casey (1981). The cationic polymers of this invention will be better understood when read in light of the Hoover article and the Casey book, the present disclosure and the Examples herein.

In some cases, charge on the polymer will depend on the pH of the composition. The nature of the polymer used depends on the compatibility of the capsule wall material with the polymer. The association can be achieved via ionic interaction, hydrogen bonding or hydrophobic interactions. Alternatively, the polymer could be crosslinked on the capsule or covalently linked to the capsule surface. The molecular weight of the polymers range from about 1000 Daltons to about 100 million Daltons or from about 500 Daltons to about 5 million Daltons.

Polysaccharide derivatives include but are not limited to cationic derivatives of cellulose, guar, alginate, starch, xanthan, chitosan dextran, and carrageenan. Preferred polysaccharides cationic guar gum, cationic starches, cationic gum arabic and cationic cellulose ethers including but not limited to cationic derivatives of hydroxyethyl cellulose, hydroxypropyl cellulose, hydroxypropyl methyl cellulose, methyl cellulose and mixed ethers and cellulose esters. Non-limiting examples of cationic groups on the polysaccharides are hydroxypropyltrimethy ammonium chloride produced by reacting a polysaccharide with 3-chloro-2 hydroxypropyl trimethyl ammonium chloride or its epoxy version, 3-chloro-2 hydroxypropyl C12-18 alkyl dimethyl ammonium chloride or its epoxy version. Cationic polysaccharides also include grafts of synthetic cationic polymers on a polysaccharide.

The preferred cationic polysaccharides are cationic starches, cationic cellulose ethers and cationic guar gums. Cationic starches are described by D. B. Solarek in *Modified Starches, Properties and Uses*, published by CRC Press (1986). Non-limiting examples of suitable commercially available cationic starches are ELECTRA 7458, LOK-SIZE 30, MYLBOND 141 (all from Tate and Lyle, London, United Kingdom), CHARGEMASTER from (Grain Processing Corporation of Muscatine, Iowa) and the CATO series (available from National Starch and Chemicals, Bridgewater, N.J.).

Examples of suitable commercially available cationic guar gums are JAGUAR EXCEL, JAGUAR C13S, JAGUAR C14S (available from Rhodia of Cranbury, N.J.), N-HANCE series (available from Aqualon of Wilmington, Del.).

Preferred cationic cellulose derivatives are 2(hydroxyl 3trimethyl ammonium) derivative of hydroxyethyl cellulose (Polyquaternium 10), poly(dimethyldiallylammonium chloride)-grafted on hydroxyethyl cellulose (Polyquaternium 4) and polyquaternium 24. Examples of suitable cationic hydroxyethyl cellulose are UCARE POLYMER JR, POLYMER LR, POLYMER LK, QUATRISOFT POLYMER LM-200 (all from Amerchol Corporation of Edison N.J.) and CELQUAT L200 and CELQUAT H100 (both from National Starch of Bridgewater, N.J.).

Another class of cationic polymers are polypeptides and proteins. Examples are silk protein, gelatin, and any polypeptide. Preferred are cationic polypeptide derivatives such as those disclosed in PCT Publications WO 99/07813 and WO 99/07814. Preferred polypeptides are gelatin and polypeptides containing at least 50% by weight of the polypeptide lysine.

Other suitable cationic polymers are:

1. Polyethyleneimine and its derivatives. These are commercially available under the trade name LUPASOL available from BASF AG of Ludwigschaefen, Germany and under the trade name EPOMIN from Nippon Shokubai Co. Ltd of Osaka, Japan.
2. Polyamidoamine-epichlorohydrin (PAE) Resins which are condensation products of polyalkylenepolyamine with polycarboxyic acid. The most common PAE resins are the condensation products of diethylenetriamine with adipic acid optionally followed by a subsequent reaction with epichlorohydrin. These polymers are described in *Wet Strength resins and Their Applications*, edited by L. L. Chan, TAPPI Press (1994). They are available from Hercules Inc. of Wilmington, Del. under the trade name KYMENE or from BASF A.G. under the trade name LURESIN.
3. Homo, co, and terpolymers of ethylenically unsaturated cationic or amine-containing monomers of the structure:

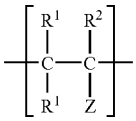

wherein $R^1$, $R^2$, and Z are defined herein below. Preferably, the linear polymer units are formed from linearly polymerizing monomers. Linearly polymerizing monomers are defined herein as monomers which under standard polymerizing conditions result in a linear polymer chain or alternatively which linearly propagate polymerization. The linearly polymerizing monomers of the present invention have the formula:

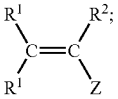

however, those of skill in the art recognize that many useful linear monomer units are introduced indirectly, inter alia, vinyl amine units, vinyl alcohol units, and not by way of linearly polymerizing monomers. For example, vinyl acetate monomers once incorporated into the backbone are hydrolyzed to form vinyl alcohol units. For the purposes of the present invention, linear polymer units may be directly introduced, i.e. via linearly polymerizing units, or indirectly, i.e. via a precursor as in the case of vinyl alcohol cited herein above.

Each $R^1$ is independently hydrogen, $C_1$-$C_4$ alkyl, substituted or unsubstituted phenyl, substituted or unsubstituted benzyl, carbocyclic, heterocyclic, and mixtures thereof. Preferably $R^1$ is hydrogen, $C_1$-$C_4$ alkyl, phenyl, and mixtures thereof, more preferably hydrogen and methyl.

Each $R^2$ is independently hydrogen, halogen, $C_1$-$C_4$ alkyl, $C_1$-$C_4$ alkoxy, substituted or unsubstituted phenyl, substituted or unsubstituted benzyl, carbocyclic, heterocyclic, and mixtures thereof. Preferred $R^2$ is hydrogen, $C_1$-$C_4$ alkyl, and mixtures thereof. Each Z is independently hydrogen; hydroxyl; halogen; —$(CH_2)_mR$, wherein R is hydrogen, hydroxyl, halogen, nitrilo, —$OR^3$, —$O(CH_2)_nN(R^3)_2$, —$O(CH_2)_nN^+(R^3)_3X^-$, —$OCO(CH_2)_nN(R^3)_2$, —$OCO(CH_2)_nN^+(R^3)_3X^-$, —C(O)NH—$(CH_2)_nN(R^3)_2$, —C(O)NH$(CH_2)_nN^+(R^3)_3X^-$, —$(CH_2)_nN(R^3)_2$, —$(CH_2)_nN^+(R^3)_3X^-$, a non-aromatic nitrogen heterocycle comprising a quaternary ammonium ion, a non-aromatic nitrogen heterocycle comprising an N-oxide moiety, an aromatic nitrogen containing heterocyclic wherein one or more or the nitrogen atoms is quaternized; an aromatic nitrogen containing heterocycle wherein at least one nitrogen is an N-oxide; —NHCHO (formamide), or mixtures thereof; wherein each $R^3$ is independently hydrogen, $C_1$-$C_8$ alkyl, $C_2$-$C_8$ hydroxyalkyl, and mixtures thereof; X is a water soluble anion; the index n is from 1 to 6; carbocyclic, heterocyclic, or mixtures thereof; —$(CH_2)_mCOR'$ wherein R' is —$OR^3$, —$O(CH_2)_nN(R^3)_2$, —$O(CH_2)_nN^+(R^3)_3X^-$, —$NR^3(CH_2)_nN(R^3)_2$, —$NR^3(CH_2)_nN^+(R^3)_3X^-$, —$(CH_2)_nN(R^3)_2$, —$(CH_2)_nN^+(R^3)_3X^-$, or mixtures thereof, wherein $R^3$, X, and n are the same as defined herein above. A preferred Z is —$O(CH_2)_nN^+(R^3)_3X^-$, wherein the index n is 2 to 4. The index m is from 0 to 6, preferably 0 to 2, more preferably 0.

Non-limiting examples of addition polymerizing monomers comprising a heterocyclic Z unit includes 1-vinyl-2-pyrrolidinone, 1-vinylimidazole, 2-vinyl-1,3-dioxolane, 4-vinyl-1-cyclohexene 1,2-epoxide, and 2-vinylpyridine.

The polymers and co-polymers of the present invention comprise Z units which have a cationic charge or which result in a unit which forms a cationic charge in situ. When the co-polymers of the present invention comprise more than one Z unit, for example, $Z^1$, $Z^2$, . . . $Z^n$ units, at least about 1% of the monomers which comprise the co-polymers will comprise a cationic unit. Preferred cationic units include $—O(CH_2)_nN^+(R^3)_3X^-$ and $—(CH_2)_nN^+(R^3)_3X^-$. When the co-polymers of the present invention are formed from two monomers, $Z^1$ and $Z^2$, the ratio of $Z^1$ to $Z^2$ is preferably from about 9:1 to about 1:9.

A non-limiting example of a Z unit which can be made to form a cationic charge in situ is the —NHCHO unit, formamide. The formulator can prepare a polymer or co-polymer comprising formamide units some of which are subsequently hydrolyzed to form vinyl amine equivalents. For example the formulator may prepare a co-polymer having the general formula:

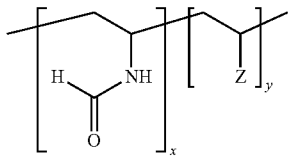

which comprises a formamide unit and then subsequently treat the co-polymer such that some of the formamide units are hydrolyzed to form a co-polymer comprising vinyl amine units, said polymer having the formula:

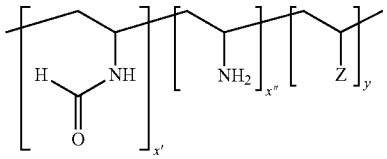

wherein Z may be a cationic unit comprising or non-cationic unit comprising moiety and x'+x"=x.

Another class of preferred linearly polymerizable monomers comprise cationically charged heteroaromatic Z units having the formula:

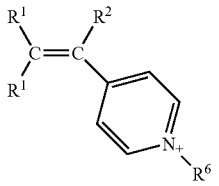

an non-limiting example of which is 4-vinyl (N-alkyl)pyridine wherein $R^1$ and $R^2$ are each hydrogen and $R^6$ is methyl.

Another class of preferred linearly polymerizable monomers which comprises a heterocyclic ring includes Z units comprising an N-oxide, for example, the N-oxide having the formula:

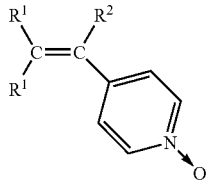

a non-limiting example of which is 4-vinyl pyridine N-oxide.

N-alkyl vinylpyridine monomers and N-oxide vinylpyridine monomers can be suitably combined with other non aromatic monomers, inter alia, vinyl amine. However, preferred polymers of the present invention include co-polymers derived from a combination of quaternized, N-oxide, and nitrogen containing heteroaromatic monomers, non-limiting examples of which includes a copolymer of N-methyl vinyl pyridine and vinyl pyridine in a ratio of 4:1; a copolymer of N-methyl vinyl pyridine and vinyl pyridine in a ratio of 4:6; a co-polymer of poly(N-methyl vinyl pyridine) and vinyl pyridine N-oxide in a ratio of polymer to monomer of 4:1; poly (N-methyl vinyl pyridine) and vinyl pyridine N-oxide in a ratio of polymer to monomer of 4:6; and mixtures thereof.

As described herein above, some preferred polymer residues may be formed by treatment of the resulting polymer. For example, vinyl amine residues are preferably introduced via formamide monomers which are subsequently hydrolyzed to the free amino unit. Also vinyl alcohol units are obtained by hydrolysis of residues formed form vinyl acetate monomers. Likewise, acrylic acid residues may be esterified after polymerization, for example, units having the formula:

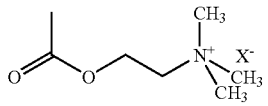

may be more conveniently formed after the backbone has been formed by polymerization with acrylic acid or acrylic acid precursor monomers.

Cyclic Units Derived from Cyclically Polymerizing Monomers

The polymers or co-polymers of the present invention can comprise one or more cyclic polymer units which are derived from cyclically polymerizing monomers. Cyclically polymerizing monomers are defined herein as monomers which under standard polymerizing conditions result in a cyclic polymer residue as well as serving to linearly propagate polymerization. Preferred cyclically polymerizing monomers of the present invention have the formula:

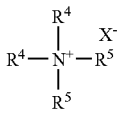

wherein each $R^4$ is independently an olefin comprising unit which is capable of propagating polymerization in addition to forming a cyclic residue with an adjacent $R^4$ unit; $R^5$ is $C_1$-$C_{12}$ linear or branched alkyl, benzyl, substituted benzyl, and mixtures thereof; X is a water soluble anion.

Non-limiting examples of $R^4$ units include allyl and alkyl substituted allyl units. Preferably the resulting cyclic residue is a six-member ring comprising a quaternary nitrogen atom.

$R^5$ is preferably $C_1$-$C_4$ alkyl, preferably methyl.

An example of a cyclically polymerizing monomer is dimethyl diallyl ammonium having the formula:

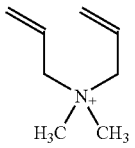

which results in a polymer or co-polymer having units with the formula:

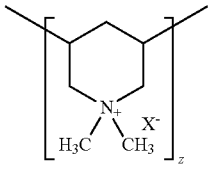

wherein preferably the index z is from about 10 to about 50,000.

Mixtures thereof.

The polymers or co-polymers of the present invention must retain a net cationic charge, whether the charged is developed in situ, or whether the polymer or co-polymer itself has a formal positive charge. Preferably the polymer or co-polymer has at least 10%, more preferably at least about 25%, more preferably at least about 35%, most preferably at least about 50% of the residues comprise a cationic charge.

The polymers or co-polymers of the present invention can comprise mixtures of linearly and cyclically polymerizing monomers, for example the poly(dimethyldiallyl-ammonium chloride/acrylamide) co-polymer having the formula:

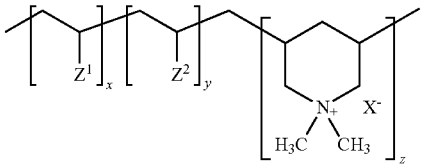

wherein $Z^1$, $Z^2$, x, y, and z are the same as defined herein above and X is chloride ion.

A particularly preferred embodiment of this invention is the composition comprising a polymer based on dimethyldiallylammonium chloride and a copolymer which is based upon acrylamide with a co-monomer selected from the group consisting of N,N dialkylaminoalkyl(meth)acrylate, N,N dialkylaminoalkylacrylate, N,N dialkylaminoalkylacrylamide, N,N dialkylaminoalkyl(meth)acrylamide, their quaternized derivatives and mixtures thereof.

Non-limiting examples of preferred polymers according to the present invention include homopolymers and copolymers of monomers i) a first monomer selected from the group consisting of N,N dimethylaminoethylmethacrylate, N,N dimethylaminoethylylacrylate, N,N dimethylaminoethylacrylamide, N,N dimethylaminoethylmethacrylamide, their quaternized derivatives, vinylamine or its derivatives, allylamine or its derivatives, vinyl imidazole and its quaternized derivative, dimathyldiallylammonium chloride, vinyl pyridine and its quaternized derivative, mixtures thereof; and ii) one or more suitable ethylenically unsaturated co-mononomer.

Another class of cationic polymers useful in the present invention is the condensation product of i) at least one amine selected from the group consisting of linear alkylamines, branched alkylamines, cycloalkylamines, alkoxyamines, amino alcohols, cyclic amines containing at least one nitrogen atom in a ring structure, alkylenediamines, polyetherdiamines, polyalkylenepolyamines, mixtures of one of the said amines with at least one amino acid or a salt thereof, reaction products of the said amines with at least one anionic group containing alkylating agent wherein per mole of NH group of the amines of from 0.04 to 0.6 moles of the anionic group containing alkylating agent is reacted, and mixtures thereof, and ii) a crosslinking agent from the group consisting of epihalohydrins, bishalohydrins of diols, bishalohydrins of polyalkylene glycols, bishalohydrins of polytetrahydrofurans, alkylene dihalides, alkylene trihalides, bisepoxides, trisepoxides, tetraepoxides and/or mixtures of said compounds.

Suitable polymers of this class are described in PCT Publications: WO 99/14297, WO 99/14299, and WO 99/14300.

Preferred polymers are condensation products of:

i. cyclic amines selected from piperazine, 1-alkylpiperazines having 1 to 25 carbon atoms in the alkyl group, 1,4-dialkylpiperazines having 1 to 25 carbon atoms in the alkyl groups, 1,4-bis(3-aminopropyl)piperazine, 1-(2-aminoethyl)piperazine, 1-(2-hydroxyalkyl)piperazines having 2 to 25 carbon atoms in the alkyl group, imidazole, $C_1$- to $C_{25}$-C-alkylimidazoles, aminoalcohols, linear, branched or cyclic alkylamines, other alkylenediamines, polyetherdiamines, polyalkylenepolyamines, or mixtures of said compounds with ii. epichlorohydrin, bishalohydrins of $C_2$- to $C_8$-diols, bisglycidyl ethers of $C_2$- to $C_{18}$-diols, bisglycidyl ethers of polyalkylene glycols, bisepoxybutane and/or alkylene dihalide Other preferred polymers are homo and copolymers of vinyl alcohol, vinyl acetate, and homo and copolymers of vinyl pyrrolidone and alkylated vinyl pyrrolidone with suitable co-monomer. Particularly preferred are poly(vinyl pyrrolidone) and copolymers of vinyl pyrrolidone with monomers selected from dimethylaminoethylmethacrylate, dimethylaminoethylacrylate, dimethylaminoethylmethacrylamide, dimethylaminoethylacrylamide, dimethylaminopropylmethacrylamide, dimethylaminopropylacrylamide and their quaternized derivatives, dimethyl diallylammonium chloride, vinylimidazole, quaternized vinylimidazole, vinylcaprolactam, vinyl acetate, vinyl propionate, vinyl butyrate, olefin, styrene, or mixtures thereof. Examples of suitable commercially available homo and copolymers of vinyl pyrrolidone are ADVANTAGE S, ADVANTAGE A, AQUAFLEX SF-40, AQUAFLEX FX-64, AQUAFLEX XL-30, COPOLYMER 845, GAFQUAT 755N and GAFQUAT 440 (Polyquaternium 11), and PVP-VA, SETLEZE 3000, PVP-K60 and PVP-K90 (commercially available from International Specialty Products of Wayne, N.J.), LUVIQUAT FC370, LUVIQUAT (commercially available from BASF Corporation. Examples of commercially available copolymers of alkylated vinylpyrrolidone are GANEX V-216 and GANEX V-220 (from International Specialty Products of Wayne, N.J.).

Optionally, the capsule could have a coating on the inner surface of the shell. The application of a coating to the inner surface of the shell capsule may be carried out by a number of methods. One approach involves the use of a suitable material for the coating which is insoluble in the material to be encapsulated, but can be dissolved in a water soluble solvent e.g. ethanol, carbitol etc., which is miscible with the material to be encapsulated. The approach involves dissolving the coating material, typically a polymer, in the solvent and then dissolving this mixture in the material to be encapsulated. The material to be encapsulated is then emulsified into e.g. a standard aminoplast capsule forming aqueous solution. As the emulsion forms, the solvent is lost to the water and the polymer precipitates out from solution at the surface of the emulsion droplets, forming a film at the interface of water/material to be encapsulated. The normal encapsulation process is then carried out and the coating deposited on the inner surface of the shell. In this case the coating material is typically water-insoluble, but this is not essential.

An inner surface coating is preferably made from a film-forming polymer, e.g. selected from: poly(ethylene-maleic anhydride), polyamine, waxes (e.g. CARBOWAX), polyvinylpyrrolidone ("PVP") and its co-polymers such as polyvinylpyrrolidone-ethyl acrylate ("PVP-EA"), polyvinylpyrrolidone-vinyl acrylate, polyvinylpyrrolidone methylacrylate ("PVP-MA"), polyvinylpyrrolidone/vinyl acetate, polyvinyl acetal, polyvinyl butyral, polysiloxane, poly(propylene maleic anhydride), maleic anhydride derivatives and co-polymers of the above, e.g. polyvinyl methyl ether/maleic anhydride. Preferably, the inner wall coating comprises polysiloxane, PVP or PVP co-polymers, more preferably PVP or PVP co-polymers, and even more preferably PVP co-polymers, particularly polyvinylpyrrolidone-methyl acrylate or polyvinylpyrrolidone-ethyl acrylate.

The coating (inner and/or outer) may be cross-linked in known manner, e.g. by interfacial cross-linking. A shell capsule useful herein may comprise more than one coating on the outer surface of the shell. Coated shell capsules typically have a wall thickness in the range from about 0.001 microns to about 30 microns, or from about 0.01 microns to about 5 microns, or from about 0.03 microns to about 1 micron, or from about The wall thickness may be regulated and controlled according to the encapsulate size and by varying the relative proportions of coating and shell polymer. The weight ratio of coating to shell wall is typically in the range of from about 0.01:1 to about 10:1 or from about 0.01:1 to about 3:1.

Typically, the weight ratio of polymer shell wall material to encapsulated material is in the range from about 1:20 to about 3:2 or from about 1:10 to about 1:2. The coating on the inner surface and/or outer surface will increase these weight ratios.

Non-limiting examples of microcapsules which may be used with the present invention include those disclosed in: U.S. Pat. No. 6,645,479 issued in the name of Shefer et al. on Nov. 11, 2003; U.S. Pat. No. 6,200,949 issued to Reijmer et al. on Mar. 13, 2001; U.S. Pat. No. 4,917,920 issued to Ono et al. on Apr. 17, 1990; U.S. Pat. No. 4,882,220 issued to Ono et al. on Nov. 21, 1989; U.S. Pat. No. 4,514,461 issued to Woo on Apr. 30, 1985; U.S. Patent No. USRE issued to Woo on Jul. 12, 1988; U.S. Pat. No. 4,234,627 issued to Schilling on Nov. 18, 1980; U.S. Pat. No. 6,592,990 issued in the name of Schwantes on Jul. 15, 2003; U.S. Application Ser. No. 60/777,629 filed on Feb. 28, 2006; EPO Publication EP 1393706; and U.S. Patent Application Publication Nos.: US2003203829; US2003215417; US2003216488; US2003158344; US2003165692; US2003195133; US2004071742; US2004071746; US2004072719; US2004072720; US20040106536; and US2004087477.

Flocculating Polymer

Compositions and systems of the present invention may optionally comprise from about 0.001%, to about 0.5%, or from about 0.01 to about 0.1% of a flocculating polymer, wherein the polymer comprises at least one cationically charged unit, inter alia, quaternary ammonium moiety or unit which can form a cationic charge in situ, inter alia, an amine moiety. Stated in another way, the oligomer, polymer, or co-polymer resulting from the herein below described monomer units have one net cationic charge at a pH of 7. The charge can be distributed among any of the herein described units.

The flocculating polymer adsorbs irreversibly on the non-woven substrate and helps flocculate or trap the dirt on it. This prevents the dirt from being smeared around on the surface that is being cleaned. The same cationic polymers discussed above which are useful to coat the outer wall of the microencapsulate shell capsule are also suitable for use as a flocculating polymer herein.

Surfactant

The compositions herein may optionally comprise from about 0.001% to about 2% by weight of a detersive surfactant. Preferably such compositions comprise from about 0.01% to about 0.5% by weight of surfactant. Suitable detersive surfactants include but are not limited to those disclosed in "*Surface Active Agents and Detergents Volumes I and Volume II*" by Schwartz, Perry and Berch or in "Surfactant Science Series" edited by Martin Schick, Arthur T. Hubbard and published by Marcel Dekker Incorporated of New York City, N.Y. Detersive surfactants useful herein are also described in U.S. Pat. No. 3,664,961 issued to Norris on May 23, 1972; U.S. Pat. No. 3,919,678, issued to Laughlin et al. on Dec. 30, 1975; U.S. Pat. No. 4,222,905 issued to Cockrell on Sep. 16, 1980; and U.S. Pat. No. 4,239,659 issued to Murphy on Dec. 16, 1980. Non-limiting examples of these surfactants include the following non-ionic surfactants:

a) $C_{12}$-$C_{18}$ alkyl ethoxylates, such as, NEODOL® nonionic surfactants from Shell;

b) $C_6$-$C_{12}$ alkyl phenol alkoxylates wherein the alkoxylate units are a mixture of ethyleneoxy and propylene units;

c) $C_{12}$-$C_{18}$ alcohol and $C_6$-$C_{12}$ alkyl phenol condensates with ethylene oxide/propylene oxide block polymers such as Pluronic® from BASF;

d) $C_{14}$-$C_{22}$ mid-chain branched alcohols, BA, as discussed in U.S. Pat. No. 6,150,322;

e) $C_{14}$-$C_{22}$ mid-chain branched alkyl alkoxylates, $BAE_x$, wherein x is from 1-30, as disclosed in U.S. Pat. No. 6,153,577, U.S. Pat. No. 6,020,303 and U.S. Pat. No. 6,093,856;

f) ether capped poly(oxyalkylated) alcohol surfactants as disclosed in U.S. Pat. No. 6,482,994 and PCT publication No. WO 01/42408; and g) alkylpolysaccharides disclosed in U.S. Pat. No. 5,776,872 issued Jul. 7, 1998 to Giret et al.; U.S. Pat. No. 5,883,059 issued Mar. 16, 1999 to Furman et al.; U.S. Pat. No. 5,883,062 issued Mar. 16, 1999 to Addison et al.; and U.S. Pat. No. 5,906,973 issued May 25, 1999 to Ouzounis et al. Other suitable alkylpolysaccharides for use herein include those disclosed in U.S. Pat. No. 4,565,647 issued to Llenado on issued Jan. 21, 1986, having a hydrophobic group containing from about 6 to about 30 carbon atoms, preferably from about 10 to about 16 carbon atoms and a polysaccharide, e.g., a polyglycoside, hydrophilic group. The alkyl substituent is preferably a saturated or unsaturated alkyl moiety containing from about 8 to about 18 carbon atoms, preferably from about 8 to about 10 carbon atoms or a mixture of such alkyl moieties. $C_8$-$C_{16}$ alkyl polyglucosides are commercially available (e.g., SIMUSOL® surfactants from Seppic Corporation, 75 Quai d'Orsay, 75321 Paris, Cedex 7, France, and GLUCOPON® 425 available from Henkel Corporation of Dusseldorf, Germany. However, it has been found that the purity of the alkyl polyglucoside can also impact performance, particularly end result for certain applications, such as daily shower product technology. In the present invention, the preferred alkyl polyglucosides are those which have been purified enough for use in personal cleansing. Most preferred are "cosmetic grade" alkyl polyglucosides, particularly $C_8$ to $C_{16}$ alkyl polyglucosides, such as PLANTAREN 2000, PLANTAREN 2000 N. and PLANRTAREN 2000 N UP® (available from Henkel Corporation of Dusseldorf, Germany).

h) polyhydroxy fatty acid amides of the formula:

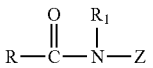

wherein R is a $C_{9-17}$ alkyl or alkenyl, $R_1$ is a methyl group and Z is glycityl derived from a reduced sugar or alkoxylated derivative thereof such as disclosed in U.S. Pat. No. 5,332,528 and PCT Publication Nos. WO 92/06162, WO 93/19146, WO 93/19038, and WO 94/09099. Processes for making polyhydroxy fatty acid amides can be found in U.S. Pat. No. 2,965,576 issued to Wilson and U.S. Pat. No. 2,703,798 issued to Schwartz.

Zwitterionic Surfactants

Non-limiting examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48, for examples of zwitterionic surfactants; betaine, including alkyl dimethyl betaine and cocodimethyl amidopropyl betaine, $C_8$ to $C_{18}$ (preferably $C_{12}$ to $C_{18}$) amine oxides and sulfo and hydroxy betaines, such as N-alkyl-N,N-dimethylammino-1-propane sulfonate where the alkyl group can be $C_8$ to $C_{18}$, preferably $C_{10}$ to $C_{14}$.

Ampholytic Surfactants

Non-limiting examples of ampholytic surfactants include: aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. See U.S. Pat. No. 3,929,678 to Laughlin et al., issued Dec. 30, 1975 at column 19, lines 18-35, for examples of ampholytic surfactants.

Anionic Surfactants

Nonlimiting examples of anionic surfactants useful herein include:

a) $C_{11}$-$C_{18}$ alkyl benzene sulfonates (LAS);

b) $C_{10}$-$C_{20}$ primary, branched-chain and random alkyl sulfates (AS);

c) $C_{10}$-$C_{18}$ secondary (2,3) alkyl sulfates having formulae (I) and (II):

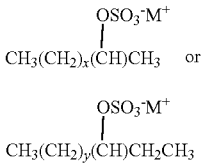

(I)

(II)

M in formulae (I) and (II) is hydrogen or a cation which provides charge neutrality. For the purposes of the present invention, all M units, whether associated with a surfactant or adjunct ingredient, can either be a hydrogen atom or a cation depending upon the form isolated by the artisan or the relative pH of the system wherein the compound is used. Non-limiting examples of preferred cations include sodium, potassium, ammonium, and mixtures thereof. Wherein x in formulae (I) and (II) is an integer of at least about 7, preferably at least about 9; y in formulae (I) and (II) is an integer of at least 8, preferably at least about 9;

d) $C_{10}$-$C_{18}$ alkyl alkoxy sulfates ($AE_xS$) wherein preferably x is from 1-30;

e) $C_{10}$-$C_{18}$ alkyl alkoxy carboxylates preferably comprising 1-5 ethoxy units;

f) mid-chain branched alkyl sulfates as discussed in U.S. Pat. Nos. 6,020,303 and 6,060,443;

g) mid-chain branched alkyl alkoxy sulfates as discussed in U.S. Pat. Nos. 6,008,181 and 6,020,303;

h) modified alkylbenzene sulfonate (MLAS) as discussed in PCT Publication Nos.: WO 99/05243, WO 99/05242, WO 99/05244, WO 99/05082, WO 99/05084, WO 99/05241, WO 99/07656, WO 00/23549, and WO 00/23548.;

i) methyl ester sulfonate (MES); and j) alpha-olefin sulfonate (AOS)

Cationic Surfactants

Non-limiting examples of anionic surfactants include: the quaternary ammonium surfactants, which can have up to 26 carbon atoms.

a) alkoxylate quaternary ammonium (AQA) surfactants as discussed in U.S. Pat. No. 6,136,769;

b) dimethyl hydroxyethyl quaternary ammonium as discussed in U.S. Pat. No. 6,004,922;

c) polyamine cationic surfactants as discussed in WO 98/35002, WO 98/35003, WO 98/35004, WO 98/35005, and WO 98/35006;

d) cationic ester surfactants as discussed in U.S. Pat. Nos. 4,228,042, 4,239,660 4,260,529 and U.S. Pat. No. 6,022,844; and e) amino surfactants as discussed in U.S. Pat. No. 6,221,825 and WO 00/47708, specifically amido propyldimethyl amine.

Semi-Polar Nonionic Surfactants

Non-limiting examples of semi-polar nonionic surfactants include: water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms. See WO 01/32816, U.S. Pat. No. 4,681,704, and U.S. Pat. No. 4,133,779.

Organic Solvent

The compositions can also include one or more organic solvents. Suitable organic solvents include but are not limited to alcohols, glycols, glycol ethers, ketones, aldehydes, ethers, alkyl pyrrolidone, and terpenes. The organic solvent may include one or more nonvolatile organic solvents at effective levels, typically from about 0.01% by weight of the composition to about 15% by weight of the composition, or from about 0.1% by weight of the composition to about 10% by weight of the composition, or from about 1% by weight of the composition to about 5%, by weight of the composition.

One non-limiting class of solvents is glycol ethers represented as:

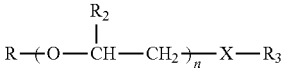

wherein:

R═$C_1$ to $C_8$ alkyl, or $C_6$ to $C_8$ alkly aryl moiety, $R_2$═H or $C_1$ to $C_4$ alkyl $R_3$═H or $C_1$ to $C_6$ alkyl, or $C_6$ to $C_8$ alkly aryl moiety X═—O— or C(O)O— group Examples of glycol ethers are ethyleneglycol methyl ether, ethyleneglycol monoethyl ether, ethyleneglycol monopropyl ether, ethyleneglycol monobutyl, ether, ethyleneglycol monohexyl ether, diethylene glycol methyl ether, diethylene glycol monoethyl ether, diethylene glycol monopropyl ether, diethylene glycol monobutyl ether, diethylene glycol monohexyl ether, triethyleneglycol monomethylether, triethyleneglycol monoethyl ether, triethyleneglycol monobutylether, ethylene glycol phenylether, diethylene glycol phenylether, tri ethylene glycol phenylether, diethylene glycol n-butyl ether acetate, diethylene glycol methyl ether acetate, ethylene glycol methyl ether acetate, ethylene glycol butyl ether acetate, propylene glycol monomethyl ether, diproppylene glycol monomethyl ether, tripropylene glycol monomethyl ether, propylene glycol monoethyl ether, diproppylene glycol monoethyl ether, tripropylene glycol monoethyl ether, propylene glycol monopropyl ether, dipropylene glycol monopropyl ether, tripropylene glycol monopropyl ether, propylene glycol monobutyl ether, diproppylene glycol monobutyl ether, tripropylene glycol monobutyl ether, propylene glycol monohexyl ether, diproppylene glycol monohexyl ether, tripropylene glycol monohexyl ether, propylene glycol phenyl ether, diproppylene glycol phenyl ether, propylene glycol methyl ether acetate, dipropylene glycol methyl ether acetate, ethylene glycol dimethyl ether, diethylene glycol dimethyl ether, triethylene glycol dimethyl ether, tetraethylene glycol dimethyl ether, propylene glycol dimethyl ether, dipropylene glycol dimethyl ether, tripropylene glycol dimethyl ether, polyethylene glycol dimethyl ether, Ethylene glycol dibutyl ether, diethylene glycol dibutyl ether, and polyethylene glycol dibutyl ether.

Nonlimiting examples of glycols are ethylene glycol, propylene glycol, butylene glycol, hexylene glycol, diethylene glycol, dipropylene glycol, polyethylene glycol of molecular weight less than 400, polypropylene glycol of molecular weight less than 400 Nonlimiting examples of alcohols are methanol, ethanol, propyl alcohol, butyl alcohol, pentyl alcohol and hexyl alcohol, benzyl alcohol, cyclohexanol and their derivatives. Nonlimiting examples of esters are ethyl acetate, propyl acetate, butyl acetate, pentyl acetate, hexyl acetate, methyl propionate, ethyl propionate, butyl propionate, pentyl propionate, ethyl 3-ethoxy propionate (U-CAR ESTER EEP available from Dow Chemicals of Midland, Mich.), glyceryl mono, di and triacetate, glyceryl mono, di and tripropionate, mixed esters of glycerine, methyl, propyl and butyl esters of glycols, preferably ethylene glycol methyl ester, propylene glycol methyl ester.

Nonlimiting examples of terpenes include hydrocarbons and terpene alcohols. These may include limonene, α and β pinene, camphene, fenchene, myrcene, cis-pinane, p-8 menthene, 3-carene, cymene, terpinene, terpinolene, cineole, pinane, cineole, fenchone, linalool, fenchol, citronellal, terpinenol, neomenthol, borneol, isoborneol, menthol, citronellol, neral, and geraniol. Additional examples of terpenes are shown in "Kirk-Othmer Encyclopedia of Chemical Technology Fourth Edition", Vol. 23, pages 832-882 published by John Wiley and Son of New York City, N.Y.

Other suitable solvents are, pyrrolidone and N-alkyl pyrrolidone such as n-octyl pyrrolidone and n-dodecyl pyrrolidone sold under the trade name SURFADONE LP-100 and SURFADONE LP-300 (available from International Specialty Products of Wayne, N.J.). Preferably, the solvent is soluble in the composition at the level used in the composition. If an insoluble solvent is used, it is solubilized using an appropriate co-solvent or emulsified using an appropriate emulsifier. Preferably, the solvent is non-volatile. The non-volatile organic solvent has a vapor pressure of less than about 0.1 mm of mercury at about 20° C. or has a boiling point of at least about 230° C. Due to their low volatility, these solvents do not evaporate rapidly and allow sufficient "working" time for the wipe before it dries out. Preferred solvents are esters, alcohols, and glycol ethers.

Such solvents typically have a terminal $C_3$-$C_6$ hydrocarbon attached to from about two to about three alkylene glycol moieties to provide the appropriate degree of hydrophobicity, high boiling point (or low vapor pressure) and, preferably, surface activity. Examples of commercially available hydrophobic cleaning solvents based on alkylene glycol chemistry include Triethyleneglycol monomethyl ether (Methoxytriglycol ether from Dow Chemical of Midland, Mich.), Diethylene glycol monoethyl ether (carbitol solvent from Dow Chemical), Triethyleneglylcol monoethyl ether (Ethoxytriglycol from Dow Chemical), diethyleneglycol butylether (Butyl Carbitol), Triethyleneglycol monobutyl ether (Butoxytriglycol ether), Diethyleneglycol monohexyl ether (Hexyl Carbitol), ethylene glycol phenyl ether (DOWANOL EPH), Dipropyleneglycol methyl ether (DOWANOL DPM), Tripropylene glycol methyl ether (DOWANOL TPM), Dipropylene glycol methylether acetate (DOWANOL DPMA), Dipropylene glycol n-propyl ether (DOWANOL DPnP), Tripropyleneglycol n-propyl ether (DOWANOL TPnP), dipropyleneglycol n-butyl ether (DOWANOL DPnB), Tripropylene glycol n-butyl ether (DOWANOL TPnB), Propyleneglycol phenyl ether (DOWANOL PPh). These solvents are commercially available from Dow Chemical of Midland, Mich.

Additional solvents of this class are available from Clariant GmbH of Werk Gendorf, Germany, examples of which include Methyl tetraglycol and buyl polyglycol.

Kit

The premoistened disposable wipe of the present invention may be provided alone or it may also optionally be provided in conjunction with an implement as a kit for cleaning household surfaces such as fabric-based materials around the house. In use, a user will typically attach the premoistened disposable wipe to the implement to facilitate cleaning. Nonlimiting implements which may be used in conjunction with the present invention include but are not limited to those disclosed in U.S. patent application Ser. No. 11/401,810 filed on Apr. 11, 2006; U.S. Publication No. 2005/0060827 published Mar. 25, 2005; and U.S. Publication No. 2006/0048318 published Mar. 9, 2006; U.S. Pat. No. 6,484,346 issued to Kingry et al. on Nov. 26, 2002, U.S. Pat. No. 6,305,046 issued to Kingry et al. on Oct. 23, 2001; U.S. Pat. No. 6,669,391 issued to Policicchio et al. on Dec. 20, 2003; and U.S. Publication No. 2002/005001 published in the name of Willman et al. on May 2, 2002. Other implements which may be used in conjunction with the premoistened wipe of the present invention include but are not limited to CLOROX READY MOP, SCOTCH BRITE TUB AND TILE SCRUBBER, and SCOTCH BRITE BATHROOM FLOOR CLEANER.

The premoistened disposable wipe of the present invention may be overwrapped. Non-limiting examples of suitable overwraps include shrink wrap, foil, or the like (not shown). The wipes may be provided in a package (not shown) such as a box, pouch, or carton. The box, pouch, or carton may optionally include a sample of the wipe so as to allow the user to touch, view, and/or smell the wipe, prior to purchase. The overwrap, box/carton/pouch, or a combination thereof may include an opening or window so as to allow the user to view and/or touch at least some portion of the wipe and/or optionally the implement if included.

Use Identifiers

Use identifiers (not shown), may be used if desired in order to identify what the premoistened disposable wipe and/or optional cleaning implement may be used for. In addition to or alternatively, one or more use identifiers can also be utilized for example to indicate the types and/or forms of surfaces the premoistened disposable wipe and/or optional cleaning implement may be used on. The use identifier may be utilized to quickly and easily communicate to a user what type of surfaces the premoistened disposable wipe and/or optional cleaning implement may be used on. Use identifiers could be included if desired on one or more of the following: on the packaging for the kit, the cleaning implement, the premoistened disposable wipe, or a combination thereof; on the cleaning implement itself; on the premoistened disposable wipe itself; on the premoistened disposable wipe(s) and/or cleaning implement overwrap; on a label attached for instance to some part of the kit including but not limited to: the package, the cleaning implement, the premoistened disposable wipe, the premoistened disposable wipe overwrap, or combinations thereof; on the use instructions; on separate print advertising; on in-store displays or the like; or combinations thereof. Non-limiting examples of the form of the use identifier could be in the form of written words, pictorials, graphics, symbols/icons, and the like, as well as combinations thereof. Non-limiting examples would be a use identifier which combines an icon and one or more words to indicate for example that the premoistened disposable wipe and/or optional cleaning implement could be used on fabric. Additional non-limiting examples include combining an icon and one or more words to indicate that the premoistened disposable wipe and/or optional cleaning implement could be used on: upholstery; draperies; pillows; comforters; bedding including but not limited to bed linens and mattress covers; car fabrics; baby/infant fabric items including but not limited to strollers and car seats, or the like; clothing; fabric clothing accessories including but not limited to purses, wallets, and shoes; or combinations thereof. For instance, one non-limiting use identifier could comprise the combination of an icon of a car with the words "car fabrics". Another non-limiting use identifier could comprise the combination of an icon of a sofa with the word "upholstery". Another non-limiting use identifier could comprise an icon of a stroller with the words "baby items". Yet another non-limiting use identifier could comprise an icon of a bed with the words "bedding".

Self-Instructing Article of Commerce

The present invention also encompasses an article of commerce comprising the premoistened disposable wipe described above. The article of commerce may also comprise a kit which includes the premoistened disposable wipe in conjunction with the cleaning implement described above. A set of instructions may be included in association with the article of commerce which directs the user to follow the method of cleaning surfaces around the house with the premoistened disposable wipe or the premoistened disposable wipe and cleaning implement. For instance, in one non-limiting embodiment, such instructions may direct the user to attach a premoistened disposable wipe to the implement and contact the area(s)/surface to be cleaned with the cleaning article. In another non-limiting embodiment, such instructions may direct the user to contact a surface to be cleaned using the premoistened disposable wipe without the implement. In yet another non-limiting embodiment, the user may be directed to remove a premoistened disposable wipe from whatever the wipe is packaged in such as an overwrap, box, carton, pouch, or the like, attach the wipe to the implement, and to contact the area(s)/surfaces to be cleaned with the wipe.

Herein, "in association with", when referring to such instructions, means the instructions are either directly printed on the implement; directly printed on the packaging for the implement and/or the cleaning sheet; printed on a label attached to the packaging for the implement and/or the cleaning sheet; or presented in a different manner including, but not limited to, a brochure, print advertisement, electronic advertisement, broadcast or internet advertisements; and/or other media, so as to communicate the set of instructions to a consumer of the implement and/or the cleaning sheet.

Method Of Treating Household Fabric-Based Materials With The Premoistened Disposable Wipe Article of the Present Invention The present invention also includes a method for treating the household fabric-based materials with the premoistended wipe of the present invention. This includes contacting the wipe to the surface to be cleaned, applying the composition to the surface to be cleaned, and transferring the dirt and contaminants from the surface to be cleaned to the wipe.

Methods

Method for Determining Capacity

Capacity may be measured using the following technique which is adapted from EDANA 10.1. A 2 inch×6 inch (5 cm×15 cm) sample of the substrate is cut, weighed and immersed in distilled water for 3 minutes. The sample is then removed and allowed to drip for 10 seconds and reweighed. The absorption capacity of the substrate reported in grams of liquid absorbed in the substrate per gram of substrate is calculated by the following equation:

(wet weight of substrate−dry weight of substrate)/dry weight of substrate.

Method for Determining Fuzz Level

This method can be used as a quantitative prediction of the level of fuzz associated with nonwoven or laminate materials. The fuzz level may be determined in accordance with the Fuzz Level Test disclosed in U.S. Publication No. 2002/0119720.

Method for Determining Caliper

Caliper is measured in accordance with EDANA (European Disposables and Nonwovens Association) Method 30.5-99 using a caliper foot pressure of 0.5 kPA. An instrument suitable for this purpose is the ProGage thickness tester available from Thwing-Albert Instrument Company of Philadelphia, Pa.

Method for Determining Stiffness

Stiffness of a dry substrate is measured in accordance with ASTM D5650-97 entitled "Standard Test Method for Resistance to Bending of Paper of Low Bending Stiffness (Taber-Type Tester in 0-10 Taber Stiffness Unit Configuration)". A suitable instrument for measuring stiffness per this method is a V-5 Teledyne Taber Stiffness Tester (model 150-B) available from Teledyne Taber Instruments of North Tonawanda, N.Y. If it is desired to determine the stiffness of a wet substrate, ASTM D5650-97 is modified by immersing each sample of substrate to be tested in distilled water for 3 minutes. The sample is then removed and allowed to drip for 10 seconds. Stiffness is then measured in accordance with ASTM D5650-97.

Method for Determining the Average Aperture Size and the % Open Area of the Substrate The following method can be used for determining the average size (i.e.; area) of the aperture in a substrate and the % open area of the substrate.

Apparatus:

HP Scanjet TMA 3970 scanner (or equivalent scanner with >200 dpi resolution) available from Hewlett-Packard Company Palo Alto, Calif. 94304 (650) 857-1501

Certified millimeter ruler (0.1 mm divisions)

Black cardboard paper

Image Pro Plus Software 4.0 or better avaiable from Media Cybernetics, Inc. Silver Spring, Md. 20910 (301)-495-3305

Computer

Printer

Sample Preparation:

Cut cardboard frames made 4.75 inches×4.75 inches (12 cm×12 cm) on the outside with inside of the frames cut out, leaving a 1 inch (2.54 cm) cardboard perimeter. Cover the frame with double-sided tape (1" wide) (2.54 cm) and place the frame on a wound roll, sticky side down, centering it over the area to be measured. With the material attached, cut around the frame to remove it from the roll.

Data Collection—Collecting Image:

Lay ruler on scanner with millimeter side face down, then lay framed sample over ruler on scanner and finally lay black cardboard paper on top of sample. Scan image into scanner per scanner instruction making sure resolution set ≧200 dpi and then use zoom to adjust the area of interest. Save image as high resolution bitmap or other uncompressed image form.

Data Analysis Using Image Pro Software

The Image Pro software is opened and the image is imported into the Image Pro software per the instructions included with the program. The spacing of the picture is calibrated by using the image and ruler to set a pixel/mm value. The area of interest in the image is selected and converted to a grey scale. The grey scale range on the count sizes is adjusted to highlight all the apertures after setting the software to aperture size and % open area. When determining aperture size, apertures that are on the edge of the sample or picture area that does not represent full apertures, should not be included. However, when determining % open area, these apertures should be included. The software will then calculate the average aperture size area and % open area.

Method of Making Premoistened Disposable Wipes

The following non-limiting methods may be used to make the premoistened disposable wipe of the present invention. To make the liquid composition, water is first added to a mix tank having an agitator. Each desired composition ingredient is added one by one to the water. After the addition of each ingredient, the solution is agitated. If a microencapsulated active is to be used, this generally is added after the non-microencapsulated ingredients are added to the mix tank. The pH of the solution is then adjusted to 7. If a microencapsulated active is to be used, the pH is adjusted to 7, prior to adding the microencapsulated ingredients. The composition is then distributed onto the wipe substrate by any suitable means, non-limiting examples of which include spraying, coating, and printing. It should be noted that the microencapsulated active may be added to the aqueous liquid composition which is then applied to the wipe substrate as described above or if desired the microencapsulated active may be applied directly to the wipe substrate by any suitable means including but not limited to the techniques described above, i.e.; spraying, coating, lotioning, and printing.

EXAMPLES

Example of Wipe Substrates

Non-limiting examples of substrates which may be used for the premoistened wipe of the present invention are disclosed below. In one non-limiting embodiment of a wipe substrate (shown as Test Substrate 1 in Table I below), a four layer apertured laminate composite may be formed from nonwoven webs. The four layer composite may be comprised of 2 outer layers which are polypropylene ("PP") carded nonwoven each of which may have a basis weight of approximately 31 grams/m$^2$ (available from BBA Nonwovens of Simpsonville, S.C. under code number FPN336) and two inner layers which are wetlaid cellulose each of which has a basis weight of approximately 23 grams/m$^2$ (available from Cellu Tissue Corporation of East Hartford, Conn. under code number 7020 HWS). This four layer composite after aperturing has a basis weight of approximately 91 grams/m$^2$ and is commercially available from Precision Fabrics Group ("PFG") of Greensboro, N.C. under style No. 36385000110000.

Another non-limiting embodiment of a wipe substrate made in accordance with the present invention (shown as Test Substrate 2 in Table I below), is a four layer apertured laminate composite formed from nonwoven webs. The four layer composite is comprised of 2 outer layers, with each being a blend of 40% 2 denier polypropylene fiber, 40% 6 denier polypropylene fiber, and 20% rayon fiber provided as a homogonously carded nonwoven. Each outer layer has a basis weight of approximately 50 grams/m$^2$ (available from BBA Nonwovens of Simpsonville, S.C. under grade number BD0216). The two inner layers are each comprised of wetlaid cellulose each of which has a basis weight of approximately 23 grams/m$^2$ (available from Cellu Tissue Corporation of East Hartford, Conn. under code number 7020 HWS). This four layer composite, after aperturing, has a basis weight of approximately 127 grams/m$^2$.

TABLE I

| Material (g/g) | Approx. Capacity ($mg/cm^2$) | Approx. Fuzz ($mg/cm^2$) | Approx. Caliper (mm) | CD* Dry Stiffness (g-cm) | CD* Wet Stiffness (g-cm) | Avg. Aperture Area ($mm^2$) | Open Area (%) |
|---|---|---|---|---|---|---|---|
| Test Substrate 1: PFG 97 $g/m^2$ PP/ cellulose composite (Style 3638 50001 10000) | 4.4 | 0.09 | 1.11 | 1.38 | 0.47 | 0.76 | 6.9 |
| Test Substrate 2: Laminate 37-2 | 6.5 | 0.28 | 1.18 | 2.80 | 2.40 | 0.46 | 6.9 |

*CD refers to the cross direction of the substrate sample.

In another non-limiting alternate embodiment, of a four layer laminate substrate (not shown in Table I), the substrate may be comprised of 2 outer layers which are polypropylene ("PP") carded nonwoven (available from BBA Nonwovens of Simpsonville, S.C. under code number FPN336) and two inner layers of cellulose each of which is comprised of BOUNTY® towel (commercially available from the instant assignee).

Examples of Aqueous Liquid Compositions

| | Example 1 Wt % | Example 2 Wt % | Example 3 Wt % | Example 4 Wt % | Example 5 Wt % | Example 6 Wt % | Example 7 Wt % |
|---|---|---|---|---|---|---|---|
| C10 Alkylpolyglucoside[1] | 0.05 | 0.05 | 0.05 | 0.05 | 0.05 | 0.05 | 0.05 |
| Polyethyleneimine[2] | 0.02 | 0.02 | 0.02 | 0.02 | 0.02 | 0.02 | 0.02 |
| Propylene glycol n-butyl ether (Dowanol PnB)[3] | 1-2 | — | — | — | — | — | — |
| Triethylene glycol monomethyl (Methoxytriglycol)[3] | — | 1-2 | — | — | — | — | — |
| Diethylene glycol monomethyl ether (Methyl Carbitol)[3] | — | — | 1-2 | — | — | — | — |
| Triethylene glycol monobutyl ether (Butoxytriglycol)[3] | — | — | — | 1 | — | — | — |
| Ethyl Acetate[4] | — | — | — | — | 1 | — | — |
| Octyl pyrrolidone (Surfadone LP-100)[5] | — | — | — | — | — | 1 | — |
| Propyleneglycol methylether acetate (Dowanol PMA)[3] | — | — | — | — | — | — | 1 |
| Perfume Microcapsules[6] | 0.1-0.2 | 0.1-0.2 | 0.1-0.4 | 0.1-0.2 | 0.1-0.2 | 0.1-0.2 | 0.1-0.2 |
| Suds suppressors, perfume and other ingredients | 0-1 | 0-1 | 0-1 | 0-1 | 0-1 | 0-1 | 0-1 |
| Water | To 100% | To 100% | To 100% | To 100% | To 100% | To 100% | To 100% |
| Target pH | 7.0-7.5 | 7.0-7.5 | 7.0-7.5 | 7.0-7.5 | 7.0-7.5 | 7.0-7.5 | 7.0-7.5 |

| | Example 8 Wt % | Example 9 Wt % | Example 10 Wt % |
|---|---|---|---|
| Sodium lauryl sulfate[4] | 0.035 | 0.035 | — |
| Lauryldimethylamine oxide[8] | 0.285 | 0.285 | — |
| Cocoamidopropyl hydroxysultaine[8] | — | — | 0.05 |
| Propylene glycol n-butyl ether (Dowanol PnB)[3] | 2.0 | — | 1.0 |
| Dipropylene glycol n-butyl ether (Dowanol DPnB)[3] | — | 2.0 | — |
| Citric Acid | 0.038 | — | 0.125 |
| Perfume Microcapsules[6] | 0.1-0.2 | 0.1-0.2 | 0.1-0.2 |
| Suds suppressors, perfume and other ingredients | 0-1 | 0-1 | 0-1 |
| Water | To 100% | To 100% | To 100% |
| Target pH | 7.0-7.5 | 7.0-7.5 | 7.0-7.5 |

| | Example 11 Wt % | Example 12 Wt % | Example 13 Wt % | Example 14 Wt % | Example 15 Wt % |
|---|---|---|---|---|---|
| C10 Alkylpolyglucoside[1] | 0.05 | 0.05 | 0.05 | 0.05 | 0.5 |
| Polyethyleneimine[2] | 0.02 | 0.02 | 0.02 | 0.02 | 0.02 |

-continued

| | | | | | |
|---|---|---|---|---|---|
| Benzyl alcohol[4] | 0.5 | — | — | 0.5 | — |
| Limonene[4] | 0.5 | 0.5 | — | — | — |
| Hexyl Cellosolve[3] | — | 2.0 | — | — | — |
| Methyl Cellosolve[3] | 1.0 | 1.0 | — | — | — |
| Triethylene glycol monomethyl ether (Methoxytriglycol)[3] | — | — | 1.0 | — | — |
| U-Car Ester EEP[3] | — | — | — | 1.0 | — |
| Ethylene glycol monobutyl ether acetate (Butyl Cellosolve acetate)[3] | — | — | — | — | 1.0 |
| Citric Acid | 0.125 | 0.125 | 0.125 | 0.3 | 0.3 |
| Perfume Microcapsules[6] | 0.1-0.2 | 0.1-0.2 | 0.1-0.2 | 0.1-0.2 | 0.1 |
| Suds suppressors, perfume and other ingredients | 0-1 | 0-1 | 0-1 | 0-1 | 0-1 |
| Water | To 100% | To 100% | To 100% | To 100% | To 100% |
| Target pH | 7.0-7.5 | 7.0-7.5 | 7.0-7.5 | 5.0-5.2 | 5.0-5.2 |

| | Example 16 Wt % | Example 17 Wt % | Example 18 Wt % | Example 19 0.05 | Example 20 Wt % |
|---|---|---|---|---|---|
| C10 Alkylpolyglucoside[1] | 0.05 | 0.05 | 0.05 | 0.02 | 0.05 |
| Polyethyleneimine[2] | 0.02 | 0.02 | 0.02 | 0.02 | 0.02 |
| Propylene glycol n-butyl ether (Dowanol PnB)[3] | 1-2 | — | — | — | — |
| Triethylene glycol monomethyl ether (Methoxytriglycol)[3] | — | 1-2 | — | — | — |
| Triethylene glycol monobutyl ether (Butoxytriglycol)[4] | — | — | 1-2 | — | — |
| Propylene glycol n-butyl ether (Dowanol PnB)[3] | — | — | — | 1-2 | — |
| Octyl Pyrrolidone (Surfadone LP-100)[5] | — | — | — | — | 1.0 |
| Perfume Capsules[7] | 0.1-0.2 | 0.1-0.2 | 0.1-0.2 | 0.1-0.2 | 0.1-0.2 |
| Citric Acid | 0.125 | 0.125 | 0.125 | 0.125 | 0.125 |
| Suds suppressors, perfume and other ingredients | 0-1 | 0-1 | 0-1 | 0-1 | 0-1 |
| Water | To 100% | To 100% | To 100% | To 100% | To 100% |
| Target pH | 7.0-7.5 | 7.0-7.5 | 7.0-7.5 | 7.0-7.5 | 7.0-7.5 |

| | Example 21 Wt % | Example 22 Wt % | Example 23 Wt % |
|---|---|---|---|
| C10 Alkylpolyglucoside[1] | 0.05 | 0.05 | 0.05 |
| Polyvinyl formamide co-vinylamine[9] | 0.02 | — | — |
| Polydimethyldiallylammoniumchloride[10] | — | 0.02 | — |
| Cationic guar gum[11] | — | — | 0.02 |
| Triethylene glycol monomethyl ether (Methoxytriglycol)[3] | 1.0 | 1.0 | 1.0 |
| Perfume Microcapsules[6] | 0.1-0.2 | 0.1-0.2 | 0.1-0.2 |
| Suds suppressors, perfume and other ingredients | 0-1 | 0-1 | 0-1 |
| Water | To 100% | To 100% | To 100% |

| | Example 24 Wt % | Example 25 Wt % | Example 26 Wt % |
|---|---|---|---|
| C10 Alkylpolyglucoside[1] | 0.05 | 0.05 | 0.05 |
| Polyethyleneimine[2] | 0.02 | 0.02 | 0.02 |
| Propylene glycol n-butyl ether (Dowanol PnB)[3] | 1-2 | — | 1-2 |
| Triethylene glycol monomethyl ether (Methoxytriglycol)[3] | — | 1-2 | — |
| Perfume Microcapsules[12] | 0.1-0.2 | 0.1-0.2 | 0.1-0.2 |
| Benzyl Alcohol[13] | — | — | 0.5 |
| 3,4,5-trimethoxybenzoic acid[13] | — | — | 0.2 |
| Suds suppressors, perfume and other ingredients | 0-1 | 0-1 | 0-1 |
| Water | To 100% | To 100% | To 100% |

[1]Surfactant available from Cognis Corp of Cincinnati, OH under the trade name PLANTAREN.

[2]Cationic flocculating polymer available from BASF AG, under the trade name LUPASOL SK having a molecular weight of 2,000,000 Daltons.

[3]Organic solvent available from Dow Chemicals, Midland MI.

[4]Organic solvent available from Sigma-Aldrich, Milwaukee, WI

[5]Organic solvent available from International Specialty Products, Wayne, New Jersey.

[6]Perfume microcapsules as disclosed in PCT Publication No. WO 04/016,234 published in the name of Quest International B.V.

[7]Perfume microcapsules as disclosed in U.S. Publication No. 2004/0072719 and U.S. Publication No. 2004/0071742 both published in the name of International Flavors and Fragrances Inc.

[8]Surfactant available from McIntyre, Inc. University Park, IL.

[9]Cationic flocculating polymer available from BASF AG having a molecular weight of 25,000 Daltons.

[10]Cationic flocculating polymers available from Calgon Corporation under the trade name MERQUAT 100 having a molecular weight of 10,000 Daltons.

[11]Cationic flocculating polymer having a molecular weight of 1,000,000 Daltons available from Aqualon Co. of Wilmington, Delaware under the tradename N-HANCE 3000.

[12]Perfume microcapsules as disclosed in U.S. Pat. No. 6,592,990 issued in the name of Schwantes on Jul. 15, 2003 and U.S. Patent Application Serial No. 60/777,629 filed on Feb. 28, 2006.

[13]Available from Aldrich of Milwaukee, Wisconsin.

The liquid composition may be prepared by mixing the ingredients followed by adjusting the pH to the appropriate with an acid/alkali. It may be applied to the substrate such that it is thoroughly wetted.

Example 27

An apertured laminate substrate PFG-97 gsm PP/cellulose composite (Style 3638 50001 010000) may be moistened with the liquid cleaning solution from any of Examples 1-26. The liquid should be thoroughly distributed so as to achieve the loading of 4.3 g of liquid per gram of dry substrate.

Example 28

An apertured laminate substrate PFG-97 gsm PP/cellulose composite (Style 3638 50001 010000) may be moistened with the liquid cleaning solution from any of Examples 1-26. The liquid should be thoroughly distributed to achieve the loading of 3.0 g of liquid per gram of dry substrate.

Example 29

An air-laid substrate Visorb X622 (basis weight 100 g/sqm, 84% NSK Pulp, 14% Bico, Buckeye Technologies, Memphis Tenn.) may be moistened with the liquid cleaning solution from any of Examples 1-26. The liquid should be thoroughly distributed to achieve the loading of 3.0 g of liquid per gram of dry substrate.

Example 30

A spunlaced substrate (Nubtex, 64 grams/sqm comprised of 70% rayon 30% polyester available from BBA Nonwovens) may be moistened with the liquid cleaning solution from any of Examples 1-26. The liquid should be thoroughly distributed to achieve the loading of 3.0 g of liquid per gram of dry substrate.

Example 31

A single ply of hydroentangled substrate comprising NSK pulp, bicomponent fiber, and rayon supplied by BBA Nonwovens may be moistened with the liquid cleaning solution from any of Examples 1-26. The liquid should be thoroughly distributed to achieve the loading of 3.5 g of liquid per gram of dry substrate.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention. All documents cited herein are in relevant part, incorporated by reference. The citation of any document is not to be construed as an admission that it is prior art with respect to the present invention.

What is claimed is:

1. A method for cleaning a household fabric-based surface, said method comprising:

a) providing a premoistened disposable wipe wherein said premoistened disposable wipe comprises:

a substrate which is comprised of at least three plies including one central ply comprised of cellulose disposed between a first outer ply and a second outer ply and which includes a composition applied to said substrate wherein said composition is applied to said substrate in the amount of from about 0.5 grams of said composition/gram of said substrate by weight to about 8 grams of said composition/gram of said substrate by weight and wherein said composition consist of:

i) from about 0.001% to about 0.5% by weight of a flocculating polymer wherein said flocculating polymer is adsorbed on said central ply;

ii) from about 0.25% to about 15% by weight of a non-volatile organic solvent;

iii) from about 0.01% to about 10% by weight of microencapsulates wherein said microencapsulate is made from the condensation product of an amine with one or more aldehydes wherein said amine is acetoguanamine;

iv) optionally, from about 0.01% to about 10% by weight of a surfactant;

v) optionally, from about 0.001% to about 1% by weight of perfume; and vi) balance water;

b) contacting said fabric to be cleaned with said premoistened disposable wipe;

c) transferring said microencapsulates from said premoistened disposable wipe to said fabric; and d) removing dirt and contaminants from said fabric to said premoistened disposable wipe.

2. The method of claim 1 wherein at least one microencapsulate ruptures upon transfer of said microencapsulates from said premoistened disposable wipe to said fabric.

3. The method of claim 1 wherein at least one microencapsulate ruptures at the time it is transferred to said fabric from said premoistened disposable wipe, at least one microencapsulate ruptures at a time after it is transferred to said fabric from said premoistened disposable wipe, or a combination thereof.

4. The method of claim 3 wherein at least one of said microencapsulate which ruptures at the time it is transferred is a perfume microencapsulate and at least one of said microencapsulate which ruptures at a time after it is transferred is a perfume microencapsulate.

* * * * *

UNITED STATES PATENT AND TRADEMARK OFFICE

CERTIFICATE OF CORRECTION

PATENT NO. : 7,947,086 B2
APPLICATION NO. : 11/443836
DATED : May 24, 2011
INVENTOR(S) : Panandiker et al.

It is certified that error appears in the above-identified patent and that said Letters Patent is hereby corrected as shown below:

Column 21

Line 50, delete "0.01:1" and insert --0.1:1--. (2 occurrences)

Column 22
Line 43, delete ''propylene" and insert --propyleneoxy --.

Column 23
Line 14, after the words PLANTAREN 2000, insert --®--.
Line 15, after the words PLANTAREN 2000 N, insert--®--.

Signed and Sealed this
Thirteenth Day of March, 2012

David J. Kappos

David J. Kappos
*Director of the United States Patent and Trademark Office*